US011883758B1

(12) United States Patent
Cody et al.

(10) Patent No.: US 11,883,758 B1
(45) Date of Patent: Jan. 30, 2024

(54) TOY VEHICLE PLAYSET

(71) Applicant: Mattel, Inc., El Segundo, CA (US)

(72) Inventors: Scott Cody, El Segundo, CA (US); Gabriel De La Torre, Los Angeles, CA (US); Gabriel Lopez, Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 18/301,518

(22) Filed: Apr. 17, 2023

(51) Int. Cl.
*A63H 17/00* (2006.01)
*A63H 33/42* (2006.01)
*A63H 18/02* (2006.01)

(52) U.S. Cl.
CPC ..... *A63H 17/008* (2013.01); *A63H 18/021* (2013.01); *A63H 33/42* (2013.01)

(58) Field of Classification Search
CPC ..... A63H 17/008; A63H 18/00; A63H 18/02; A63H 18/021; A63H 18/025; A63H 18/06; A63H 33/42
USPC ..... 446/168, 170, 171, 172, 173, 174, 431, 446/444, 445, 446, 447
See application file for complete search history.

(56) References Cited

U.S. PATENT DOCUMENTS

X159928 2/1875 Hotchkiss
162,141 A * 4/1875 Bayles ..... A63F 9/26 273/110
586,437 A * 7/1897 Howe ..... A63F 7/386 273/110
644,209 A * 2/1900 Murphy ..... A63F 7/044 273/450
1,152,639 A 9/1915 Isaacs
1,473,419 A 11/1923 Cudlipp
1,701,503 A * 2/1929 Marx ..... A63G 1/38 472/28
1,768,016 A * 6/1930 Walker ..... A63F 7/386 273/110
1,970,341 A * 8/1934 Schauweker ..... A63H 17/44 446/424
2,767,986 A * 10/1956 Newberry ..... A63F 9/14 446/444
2,803,922 A 8/1957 Holt
3,126,880 A 3/1964 Loe
3,428,310 A * 2/1969 Leath ..... A63H 18/06 446/444
3,562,949 A 2/1971 Beny et al.
3,585,751 A 6/1971 Beny et al.
3,600,849 A 8/1971 Faller
3,621,607 A 11/1971 Morrison et al.
3,670,453 A 6/1972 Cosp
3,693,282 A 9/1972 Adicks
(Continued)

FOREIGN PATENT DOCUMENTS

WO 1992009350 A1 6/1992
WO 1998014255 A1 4/1998

*Primary Examiner* — Joseph B Baldori
(74) *Attorney, Agent, or Firm* — Edell, Shapiro & Finnan, LLC

(57) ABSTRACT

A toy playset is presented herein. The toy playset includes a base section, a track section configured to receive a toy vehicle, and a biasing member coupled to the base section and to the track section. The biasing member is configured to bias the base section and the track section away from one another, and the biasing member is configured to flex to enable the base section and the track section to move relative to one another.

16 Claims, 19 Drawing Sheets

(56) References Cited

U.S. PATENT DOCUMENTS 3,750,328 A 8/1973 Nielsen et al.
3,764,134 A * 10/1973 Reinertsen ..... A63F 9/26 273/287
3,822,885 A * 7/1974 Domka ..... A63F 7/386 273/110
3,839,820 A 10/1974 Serman, Jr.
3,844,562 A * 10/1974 Foley ..... A63F 7/386 273/110
3,879,039 A * 4/1975 Holden ..... A63F 7/0017 273/110
3,905,350 A 9/1975 Becker
3,952,442 A 4/1976 Livesey et al.
3,964,745 A * 6/1976 Ogg ..... A63H 33/18 473/588
3,977,122 A 8/1976 Meyer et al.
4,016,674 A 4/1977 Resnick et al.
4,094,507 A * 6/1978 Kauffmann ..... A63F 7/386 273/110
4,106,768 A * 8/1978 Kanno ..... A63H 18/10 273/443
4,108,437 A 8/1978 DeAnda et al.
4,134,228 A 1/1979 Ortiz
4,203,247 A 5/1980 Moe et al.
4,227,693 A * 10/1980 Moe ..... A63H 18/06 446/444
4,267,661 A 5/1981 Hanson
4,345,402 A 8/1982 Hanson et al.
4,380,339 A * 4/1983 Jones, Jr. ..... A63F 9/0204 273/379
4,403,440 A 9/1983 Wulff
4,418,495 A 12/1983 Kennedy et al.
4,423,871 A 1/1984 Mucaro
4,472,906 A 9/1984 Cook et al.
4,475,303 A 10/1984 Ribas et al.
4,480,400 A 11/1984 diDonato
4,504,242 A 3/1985 Crain et al.
4,564,197 A 1/1986 Lambert et al.
4,605,230 A 8/1986 Halford et al.
4,642,066 A 2/1987 Kennedy et al.
4,643,692 A * 2/1987 Magers ..... A63H 1/20 446/259
4,673,182 A * 6/1987 Bowen ..... A63F 9/14 104/53
4,690,658 A 9/1987 Crosson et al.
4,737,135 A 4/1988 Johnson et al.
4,867,723 A 9/1989 Asbach
4,992,072 A * 2/1991 Leigh ..... A63H 33/00 446/486
5,056,764 A * 10/1991 Mochizuki ..... A63H 17/26 403/324
5,069,650 A * 12/1991 Lehmann ..... A63H 13/16 446/486
5,222,738 A * 6/1993 Muller ..... A63F 5/048 446/241
5,254,030 A 10/1993 Ostendorff et al.
5,338,246 A * 8/1994 Suto ..... A63H 17/262 446/466
5,377,595 A * 1/1995 Liu ..... A63H 21/04 104/53
5,617,658 A * 4/1997 Chen ..... G09F 19/08 472/12
5,674,105 A 10/1997 Hamlin
5,785,005 A * 7/1998 Udelle ..... A01K 15/025 119/706
5,906,870 A * 5/1999 Lo ..... A63H 13/20 428/542.2
6,000,992 A 12/1999 Lambert
6,216,600 B1 * 4/2001 Verret ..... A63H 18/028 248/237
6,276,279 B1 * 8/2001 Stephenson ..... A63H 18/06 238/10 F
6,485,018 B2 * 11/2002 Lorenz ..... A63F 7/386 273/110
6,491,567 B2 * 12/2002 Chan ..... A63H 33/06 446/478
6,637,814 B1 10/2003 Bellows et al.
6,715,714 B2 * 4/2004 Temple ..... B64C 25/62 244/104 R
6,715,826 B2 4/2004 Bellows et al.
6,899,589 B1 5/2005 Lund et al.
9,364,768 B2 6/2016 Williams
9,387,410 B1 7/2016 Tao et al.
9,844,735 B2 12/2017 Tao et al.
10,000,225 B2 6/2018 Burns et al.
10,442,451 B2 10/2019 Burns et al.
10,456,701 B2 10/2019 Healy et al.
2008/0070472 A1 3/2008 Campbell
2008/0096460 A1 4/2008 Sandoval et al.
2009/0075556 A1 3/2009 Sun et al.
2010/0323582 A1 12/2010 Sandoval et al.
2012/0270472 A1 10/2012 Sandoval et al.
2014/0017970 A1 1/2014 Comfort
2015/0343319 A1 12/2015 O'Connor et al.
2017/0312644 A1 11/2017 Meir

* cited by examiner

TOY VEHICLE PLAYSET

TECHNICAL FIELD

The present application relates generally to toy playsets and, in particular, to a toy playset having toy vehicle features.

BACKGROUND

Toy playsets provide entertainment for different users, such as children. For example, a toy playset includes a track and a toy vehicle. A user can move the toy vehicle along the track to interact with the toy playset. Such interaction can portray a realistic appearance and/or sensation of movement of a real-world vehicle. The toy playset can also include various features that provide effects to entertain the user in an immersive manner.

SUMMARY

A toy playset is presented herein. According to one example embodiment, the toy playset includes a base section, a track section configured to receive a toy vehicle, and a biasing member coupled to the base section and to the track section. The biasing member is configured to bias the base section and the track section away from one another, and the biasing member is configured to flex to enable the base section and the track section to move relative to one another.

Other systems, methods, features and advantages will be, or will become, apparent to one with skill in the art upon examination of the following figures and detailed description. All such additional systems, methods, features, and advantages are included within this description, are within the scope of the claimed subject matter.

BRIEF DESCRIPTION OF THE DRAWINGS

The toy playset presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy vehicle booster. In the figures, like-referenced numerals designate corresponding parts throughout the different views.

DETAILED DESCRIPTION

Overall, a toy playset is presented herein. The toy playset includes a track section and a base section. A biasing joint engages with the track section and the base section, and the biasing joint enables relative movement of the track section and the base section with respect to one another. For example, the biasing joint includes a biasing member that urges movement of the track section and the base section away from one another. The biasing joint also includes a rod configured to couple the track section and the base section to one another. The biasing member is able to flex to enable relative movement of the track section and the base section with respect to one another, and the rod maintains the coupling of the track section and the base section to one another during such relative movement. The movement of the track section relative to the base section is a unique feature that may entertain a user.

Figure 1:
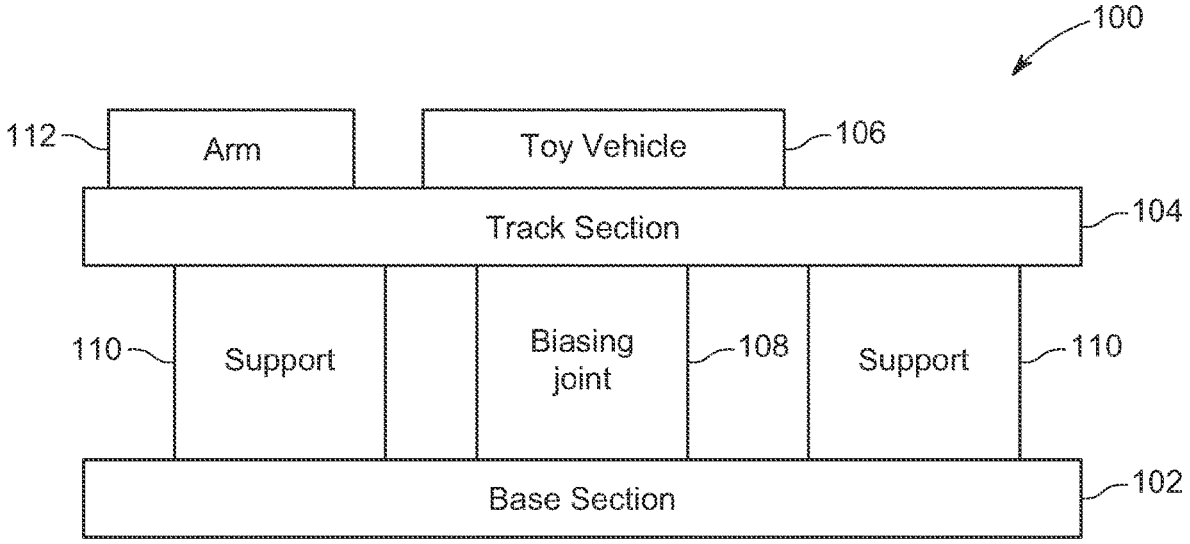
FIG. 1 illustrates a schematic diagram of a toy playset in accordance with an example embodiment of the present application.

FIG. 1 illustrates a schematic diagram of an embodiment of a toy playset 100. The toy playset 100 includes a base section 102 and a track section 104. The toy playset 100 also includes a toy vehicle 106. A user may move the toy vehicle 106 relative to the base section 102 and/or relative to the track section 104. For example, the user may move the toy vehicle 106 in engagement with and along the track section 104. The user may additionally or alternatively move the toy vehicle 106 in engagement with and along the base section 102. Such movement of the toy vehicle 106 may, for instance, emulate driving of the toy vehicle 106 along a path.

The toy playset 100 includes a biasing joint 108 configured to engage with the base section 102 and with the track section 104. The biasing joint 108 enables movement of the base section 102 and the track section 104 relative to one another. For example, the biasing joint 108 biases the base section 102 and the track section 104 away from one another to offset a portion of the base section 102 from a portion of the track section 104, or vice versa. The biasing joint 108 is also configured to flex to enable movement of the base section 102 and the track section 104 relative to one another.

By way of example, the base section 102 and the track section 104 are configured to roll, pitch, and/or yaw relative to one another about the biasing joint 108. However, the base section 102 may be frictionally engaged with a support surface of the track section 104 and, thus, a majority of movement may be imparted to the track section 104.

As an example, movement of the toy vehicle 106 along the track section 104 may impart a force onto the track section 104 that causes the track section 104 to move relative to the base section 102 via the biasing joint 108. As another example, movement of the toy vehicle 106 along the base section 102 may impart a force onto the base section 102 that causes the base section 102 to move relative to the track section 104 via the biasing joint 108. Such relative movement of the base section 102 and the track section 104 with respect to one another may enhance the entertaining experience of the user. For instance, relative movement of the base section 102 and the track section 104 with respect to one another provides unique sensations and tactile feedback for the user interacting with the toy vehicle 106 (e.g., replicating the feel of a monster truck moving haphazardly over rough terrain and/or obstacles).

In some embodiments, the toy playset 100 also includes one or more supports 110 (e.g., auxiliary supports) that maintain coupling of the track section 104 and the base section 102 to one another. For example, the supports 110 may moveably couple to the base section 102 and to the track section 104. Thus, each of the base section 102 and the track section 104 may move relative to the supports 110, and therefore move relative to one another, while remaining coupled to the supports 110, and therefore coupled to one another. Additionally or alternatively, the supports 110 can block certain movement of the base section 102 and the track section 104 relative to one another. For instance, in the depicted embodiment the supports 110 block movement of the base section 102 and the track section 104 beyond a threshold degree of movement. As such, the supports 110 provide additional bolstering to maintain positioning of a portion of the base section 102 and of a portion of the track section 104 within a threshold distance of one another, which may help maintain a structural integrity of the toy playset 100.

The toy playset 100 further includes an arm 112, which is coupled to the track section 104 in the illustrated embodiment. The arm 112 is configured to drive movement of the toy vehicle 106 (e.g., along the track section 104). For instance, the arm 112 is configured to transition between a loaded configuration and a rest configuration, such as via a force manually applied by the user. Transition of the arm 112 from the loaded configuration toward the rest configuration may cause the arm 112 to contact the toy vehicle 106, thereby driving movement of the toy vehicle 106. In this manner, the arm 112 may be utilized by the user to propel the toy vehicle 106 and further entertain the user. The arm 112 may also be specifically tuned for larger toy vehicles (e.g., scale models of monster trucks), e.g., by including an extension specifically designed to engage a chassis portion of such vehicles and/or configured to rotate in a manner that encourages propulsion without creating lift, as is detailed herein.

Figure 2:
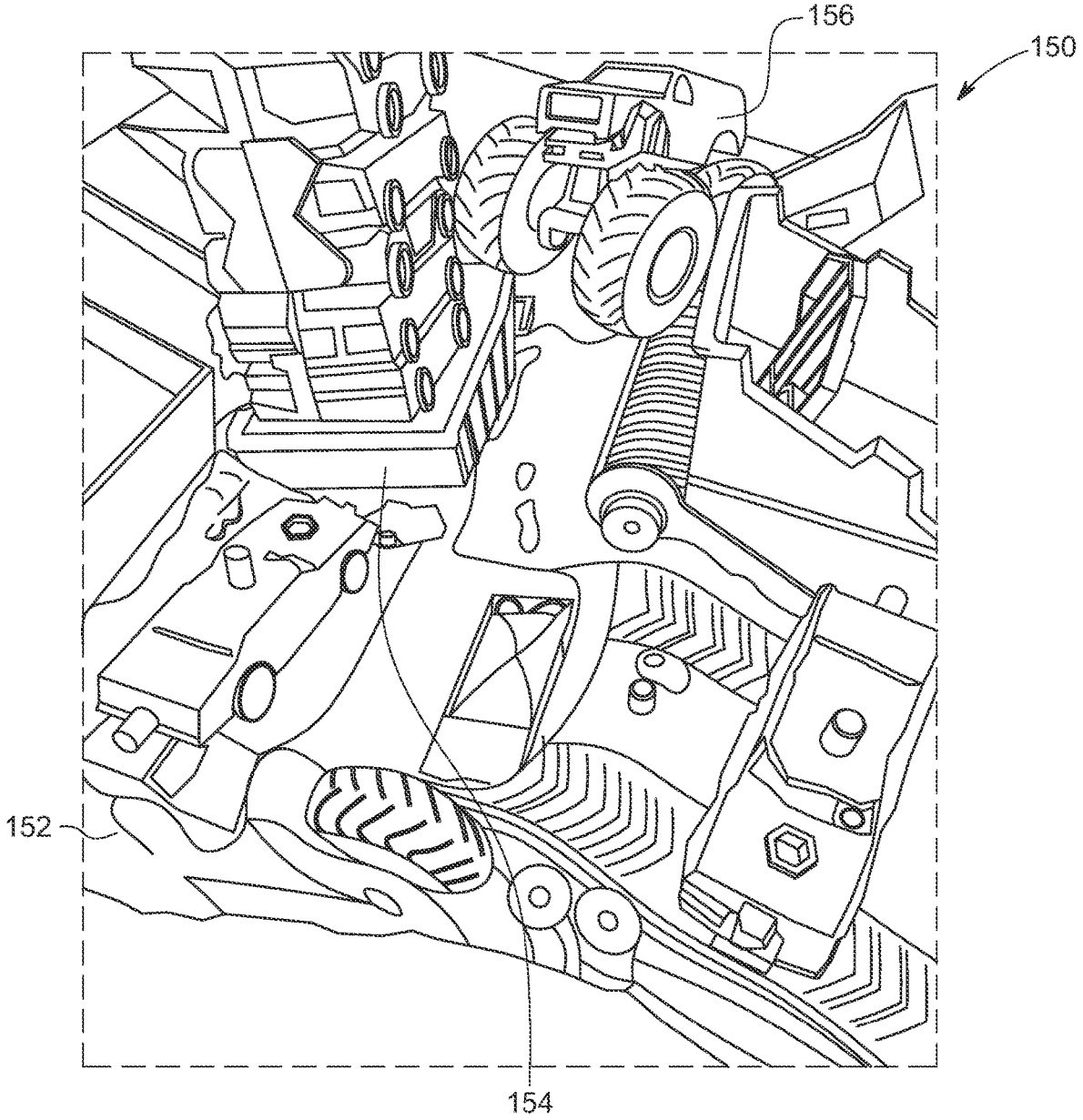
FIG. 2 illustrates a perspective view of a portion of a toy playset in accordance with an example embodiment of the present application.

FIG. 2 illustrates a perspective view of a toy playset 150 that includes a base section 152 and a track section 154. The track section 154 is configured to couple to a biasing joint (not shown in FIG. 2), and the track section 154 may move relative to the base section 152 about the biasing joint. For example, engagement of a toy vehicle 156 with the track section 154 may impart a force onto the track section 154 to drive movement of the track section 154 relative to the base section 152, such as to roll, pitch, and/or yaw the track section 154 about the base section 152 via the biasing joint. The biasing joint may maintain coupling of the track section 154 and the base section 152 to one another during such movement. Thus, the biasing joint enables relative movement of the base section 152 and the track section 154 with respect to one another to entertain the user while maintaining assembly of the toy playset 150.

Figure 3:
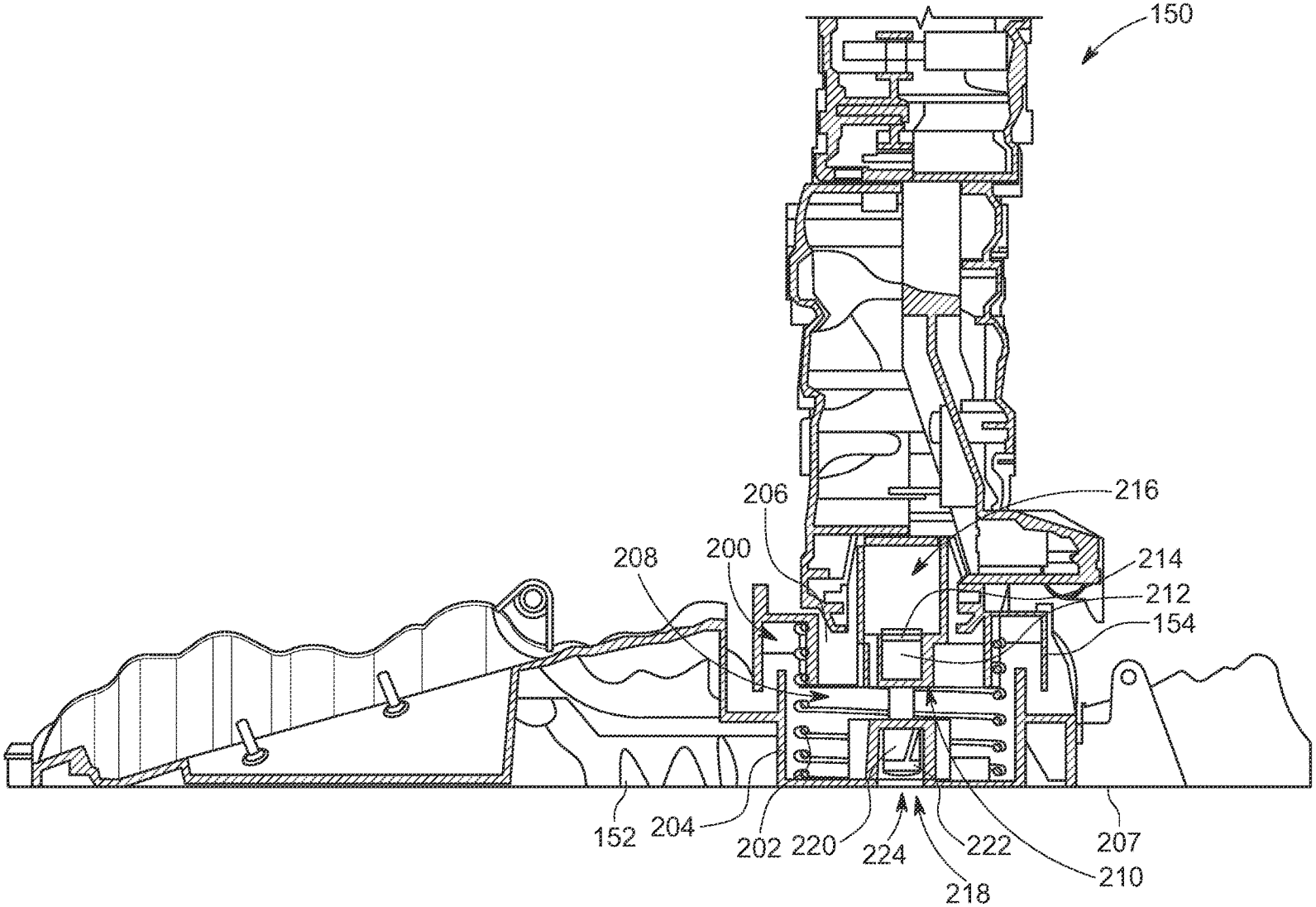
FIG. 3 illustrates a cross-sectional view of the toy playset of FIG. 2.

FIG. 3 illustrates a cross-sectional view of the toy playset 150 in which the base section 152 and the track section 154 are coupled to one another via a biasing joint 200. In the depicted embodiment, the biasing joint 200 includes a biasing member 202 that extends into a receptacle 204 defined by the base section 152. Additionally, the biasing joint 200 includes a mount 206 coupled to the biasing member 202, such as via an interference fit, an adhesive, and/or a fastener. The biasing member 202 imparts a force that biases the base section 152 and the mount 206 away from one another. However, a manually applied force can overcome the force imparted by the biasing member 202 to flex and deform (e.g., elastically deform) the biasing member 202, thereby driving movement of the mount 206 relative to the biasing member 202 and relative to the base section 152 into which the biasing member 202 extends. Absent the manually applied force, the force imparted by the biasing member 202 moves the mount 206 to a default orientation with respect to the biasing member 202 and/or with respect to the base section 152, such as an orientation in which the mount 206 extends substantially parallel to a surface 207 of the base section 152.

The track section 154 is coupled (e.g., fixedly coupled) to the mount 206, such as via an interference fit, an adhesive, and/or a fastener. Thus, movement of the track section 154 (e.g., effectuated by the user) drives movement of the mount 206, and movement of the mount 206 (e.g., effectuated by the biasing member 202) drives movement of the track section 154. For this reason, the force imparted by the biasing member 202 to bias the base section 152 and the mount 206 away from one another also biases the base section 152 and the track section 154 away from one another.

The biasing joint 200 further includes a rod 208 (e.g., a primary support) configured to couple the mount 206 and the base section 152 to one another, thereby coupling the track section 154 attached to the mount 206 and the base section 152 to one another. In the depicted embodiment, the mount 206 defines a first aperture 210 and includes first projections 212 that extend into and around the first aperture 210. The rod 208 includes a first lip 214 at a first end 216, and the first lip 214 is configured to abut the first projections 212 to block movement of the rod 208 out of the first aperture 210, thereby retaining the rod 208 within the first aperture 210 to couple the rod 208 to the mount 206. Additionally, the base section 152 defines a second aperture 218 and includes second projections 220 that extend into and around the second aperture 218. The rod 208 includes a second lip 222 at a second end 224, and the second lip 222 is configured to abut the second projections 220 to block movement of the rod 208 out of the second aperture 218, thereby retaining the rod 208 within the second aperture 218 to couple the rod 208 to the base section 152. Retaining the rod 208 within the first aperture 210 and within the second aperture 218 secures the mount 206 and the base section 152 to one another, thereby securing the base section 152 to the biasing member 202 and to the track section 154 coupled to the mount 206. However, in other embodiments, rod 208 could be secured within apertures 210, 218 in any desired manner.

Additionally, the rod 208 may move relative to the base section 152 and/or relative to the track section 154. For example, the rod 208 may slide through the second aperture 218 to move relative to the base section 152, such as to move the second lip 222 away from the second projections 220, and the rod 208 may slide through the first aperture 210 to move relative to mount 206 and relative to the track section 154 coupled to the mount 206, such as to move the first lip 214 away from the first projections 212. Movement of the rod 208 relative to the base section 152 and relative to the track section 154 enables the track section 154 and the base section 152 to move relative to one another. By way of example, a force imparted onto the track section 154 may cause the mount 206 to translate along the rod 208 and/or may cause the rod 208 to translate along the base section 152 and compress part of the biasing member 202 to drive a portion of the track section 154 toward a portion of the base section 152. Absent the force imparted onto the track section 154, the force imparted by the biasing member 202 drives the mount 206 and the base section 152 away from one another and along the rod 208 to cause the lips 214, 222 of the rod 208 to remain proximate to and/or abut the projections 212, 220, respectively.

In the illustrated embodiment, the biasing member 202 is a coil spring that surrounds the first aperture 210 and the second aperture 218. Thus, the rod 208 extends through the biasing member 202. However, in additional or alternative embodiments, the biasing member 202 can include a different component, such as a gas spring, that biases the base section 152 and the mount 206 away from one another. Additionally, the rod 208 may extend externally alongside, rather than through, the biasing member 202. Still further, in some embodiments, a single component may act as the biasing member 202 and the rod 208.

Figure 4:
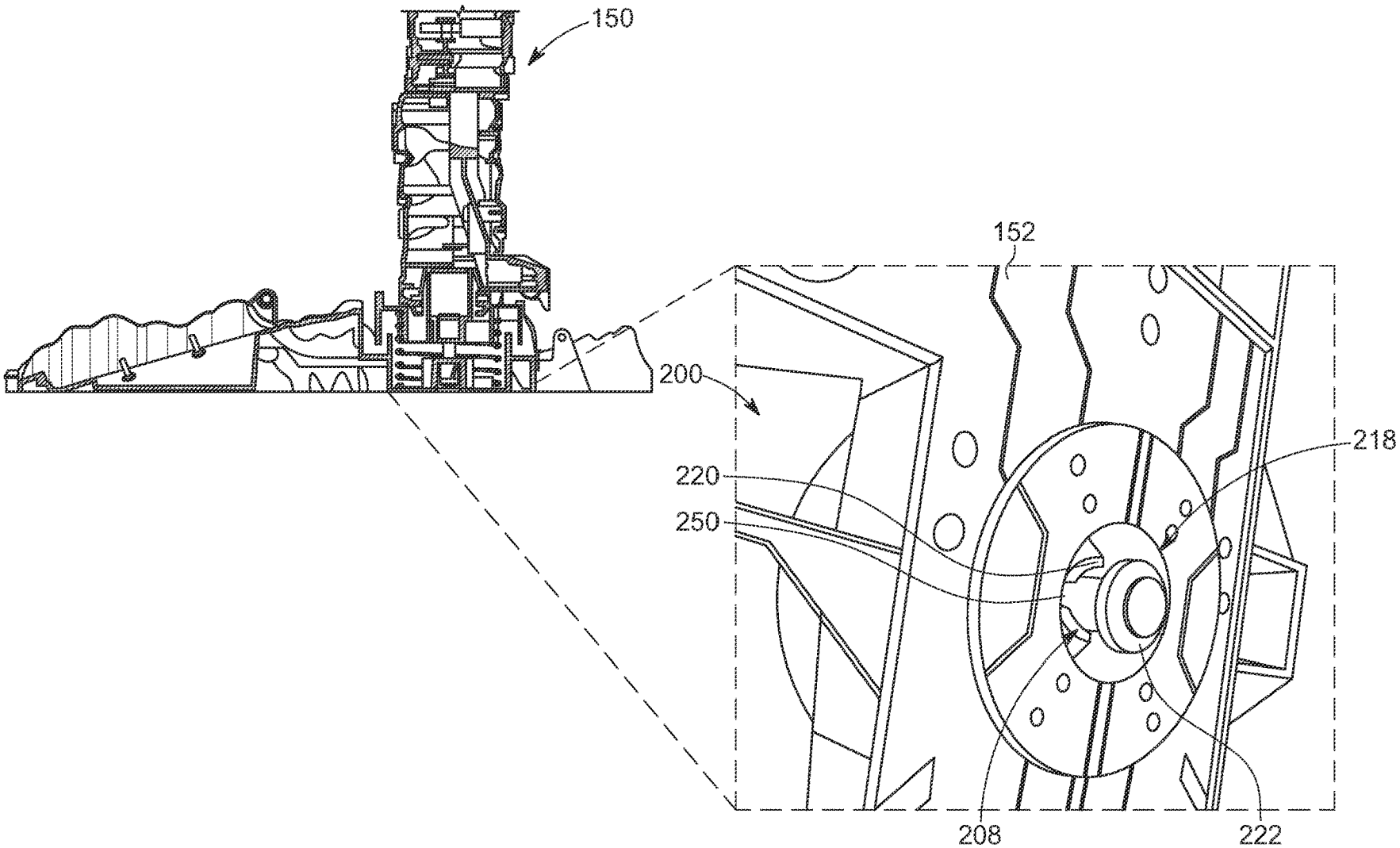
FIG. 4 illustrates a perspective view of a first portion of a biasing joint of the toy playset of FIG. 2.

FIG. 4 illustrates a perspective view of the biasing joint 200 of the toy playset 150. In the illustrated embodiment, a shaft 250 of the rod 208 extends between the second projections 220 and into the second aperture 218 to position the second lip 222 offset from the second projections 220. Additionally, a space formed between the second projections 220 is larger than the size of the shaft 250. For this reason, the shaft 250 is able to move in the space between the second projections 220. As an example, the shaft 250 may rotate and/or translate toward one of the second projections 220 and away from another one of the second projections 220. Such movement of the shaft 250 between the second projections 220 and within the second aperture 218 may enable corresponding movement of the mount 206, as well as of the biasing member 202 and the track section 154 coupled to the mount 206, relative to the base section 152.

Figure 5:
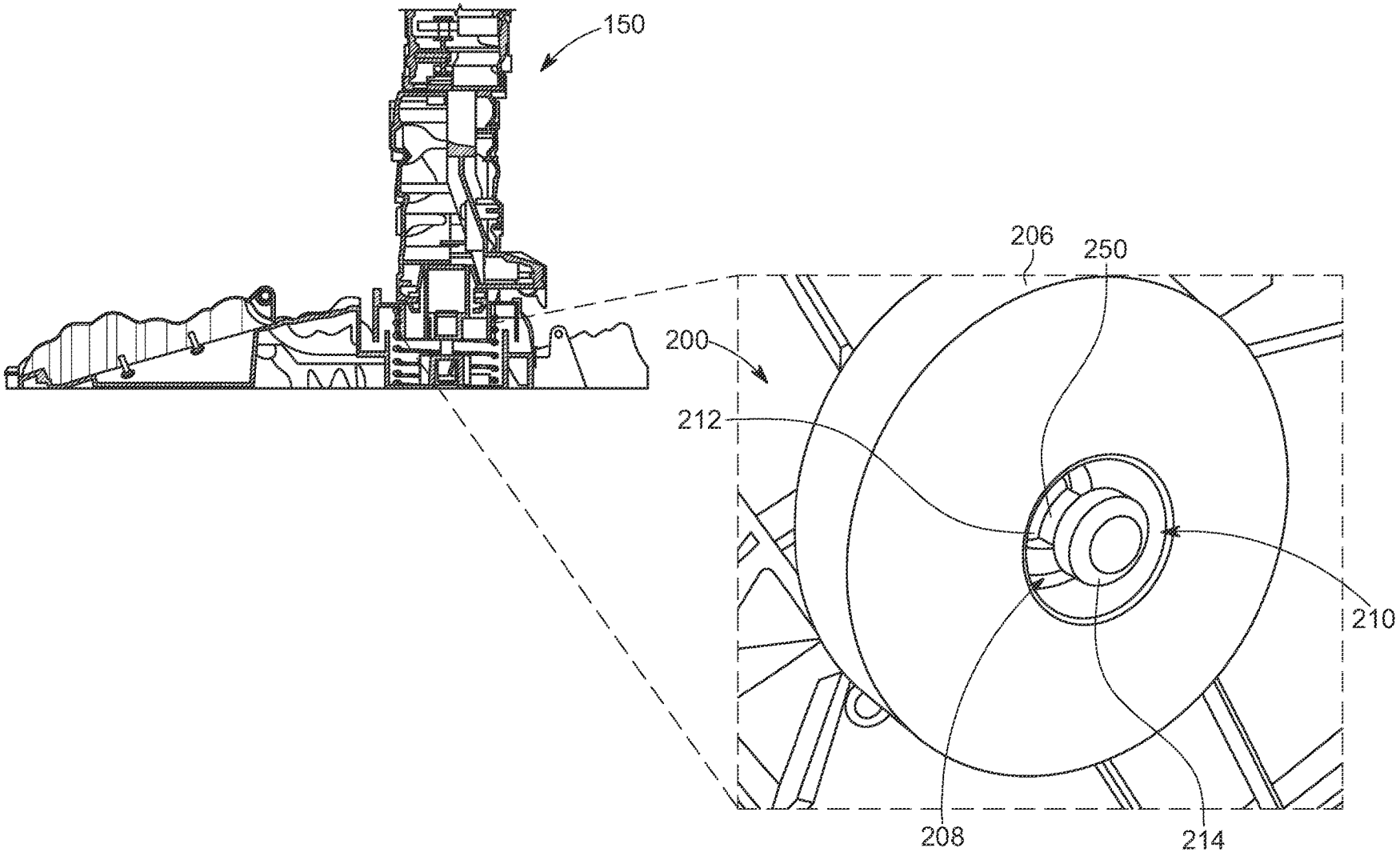
FIG. 5 illustrates a perspective view of a second portion of the biasing joint of the toy playset of FIG. 2.

FIG. 5 illustrates a perspective view of the biasing joint 200 of the toy playset 150 in which the shaft 250 of the rod 208 extends between the first projections 212 and into the first aperture 210 to position the first lip 214 offset from the first projections 212. The track section 154 is not shown in FIG. 5 for visualization purposes. A space formed between the first projections 212 is larger than the size of the shaft 250 to enable the shaft 250 to move in the space between the first projections 212, such as toward one of the first projections 212 and away from another one of the first projections 212. Such movement of the shaft 250 between the first projections 212 and within the first aperture 210 may enable additional corresponding movement of the mount 206, as well as of the biasing member 202 and the track section 154 coupled to the mount 206, relative to the base section 152.

Figure 6:
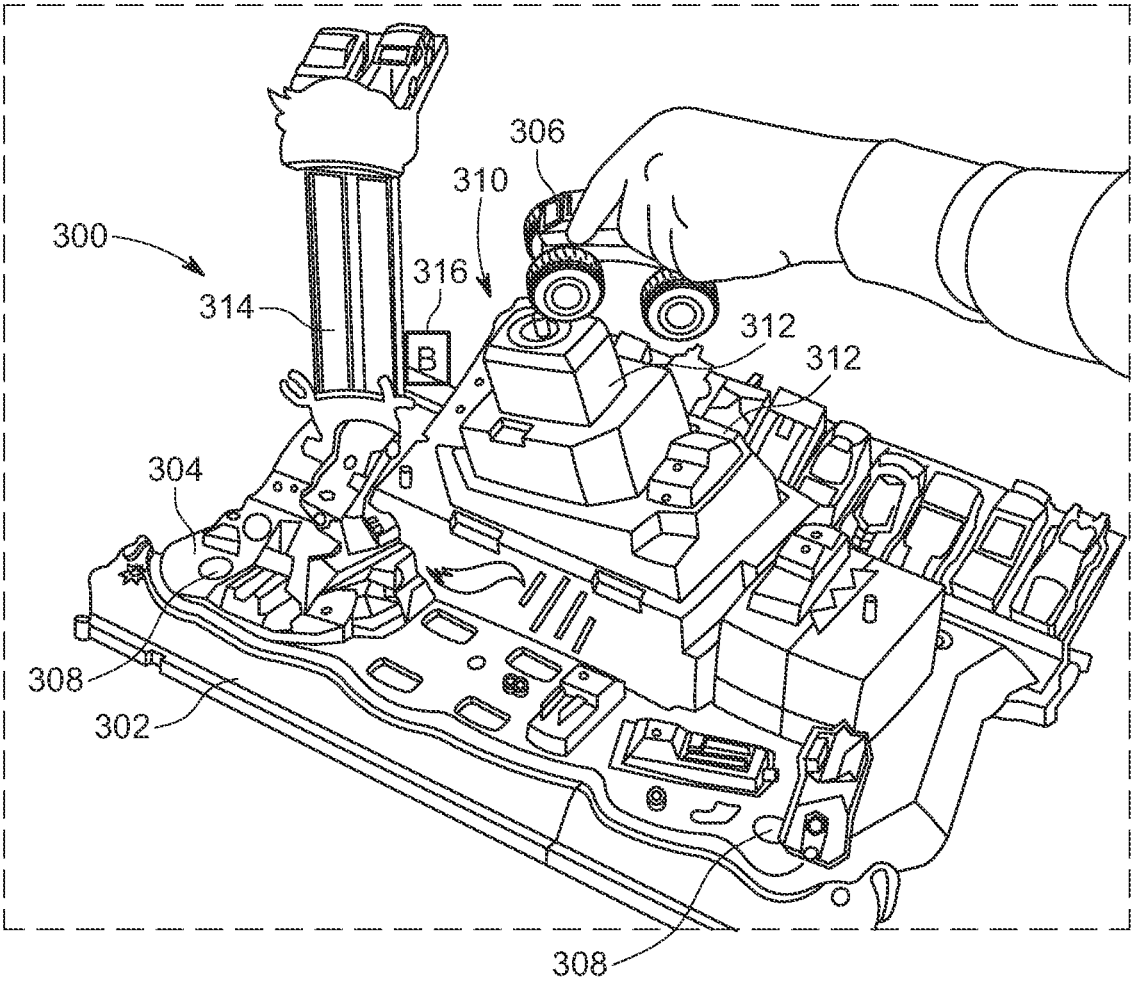
FIG. 6 illustrates a perspective view of a toy playset in accordance with another example embodiment of the present application.

FIG. 6 illustrates a perspective view of another example embodiment of a toy playset 300. The toy playset 300 includes a base section 302 and a track section 304 coupled to one another via a biasing joint 350 (see FIG. 7). The track section 304 may move relative to the base section 302 about the biasing joint 350, such as resulting from a force applied by a user via a toy vehicle 306. Such relative movement may include roll, pitch, and/or yaw of the track section 304 relative to the base section 302. The biasing joint 350 may maintain coupling of the base section 302 and the track section 304 to one another. Moreover, the toy playset 300 includes additional supports 308 (e.g., auxiliary supports) that secure the base section 302 and the track section 304 to one another.

The toy playset 300 may include other features, accessories, or components attached to the track section 304, and movement of the track section 304 relative to the base section 302 may cause actuation of such features. As an example, a tower 310 is coupled to the track section 304, and the tower 310 includes multiple tower portions 312 that are coupled to and can move relative to one another (e.g., via a spring-loaded telescoping mechanism). Movement of the track section 304 relative to the base section 302 may induce movement of the tower portions 312 to actuate the tower 310. As another example, a component 314 is coupled to the track section 304. A component biasing member 316 may be configured to urge movement (e.g., rotation) of the component 314 relative to the track section 304. The component 314 may engage with a latch to secure the position of the component 314 relative to the track section 304. Movement of the track section 304 relative to the base section 302 may cause the track section 304 to contact the latch and disengage the latch from the component 314 to cause the component biasing member 316 to move the component 314 relative to the track section 304, thereby actuating the component 314.

Figure 7:
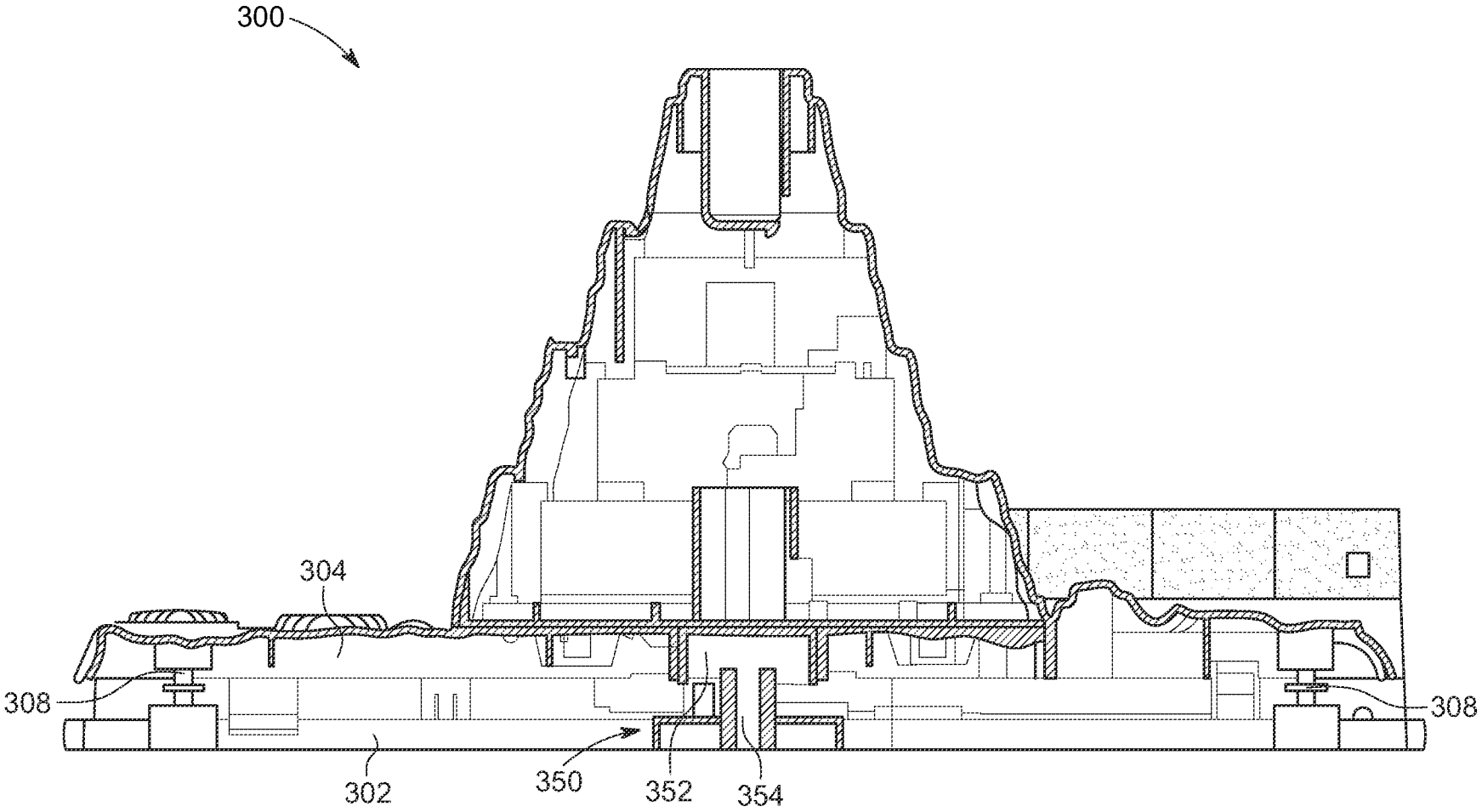
FIG. 7 illustrates a cross-sectional view of the toy playset of FIG. 6.

FIG. 7 illustrates a cross-sectional view of the toy playset 300 in which the base section 302 and the track section 304 are coupled to one another via a biasing joint 350. For example, the biasing joint 350 may be similar to the biasing joint 200 and may have a biasing member (not shown), a mount 352 coupled to the track section 304, and a rod 354 (e.g., a primary support) coupled to the mount 352 and to the base section 302. The biasing member imparts a force that biases the base section 302 and the mount 352, as well as the track section 304 coupled to the mount 352, away from one another. Additionally, the base section 302 and/or the mount 352 is movable relative to the rod 354 to enable movement of the base section 302 and the track section 304 relative to one another (e.g., by overcoming the force imparted by the biasing member).

The base section 302 and the track section 304 may additionally be coupled to one another via the supports 308. For example, the supports 308 are positioned external to and separate from the biasing joint 350. Each support 308 includes a rod that extends through the base section 302 and the track section 304. The base section 302 and/or the track section 304 may move along the supports 308 to enable movement of the base section 302 and the track section 304 relative to one another. However, extension of the supports 308 through the base section 302 and the track section 304 is maintained. For this reason, the supports 308 maintain a coupling between the base section 302 and the track section 304. For instance, retention of the supports 308 within the base section 302 and within the track section 304 can block movement of a portion of the base section 302 and a portion of the track section 304 beyond a threshold distance away from one another to couple the base section 302 and the track section 304 to one another.

Figure 8:
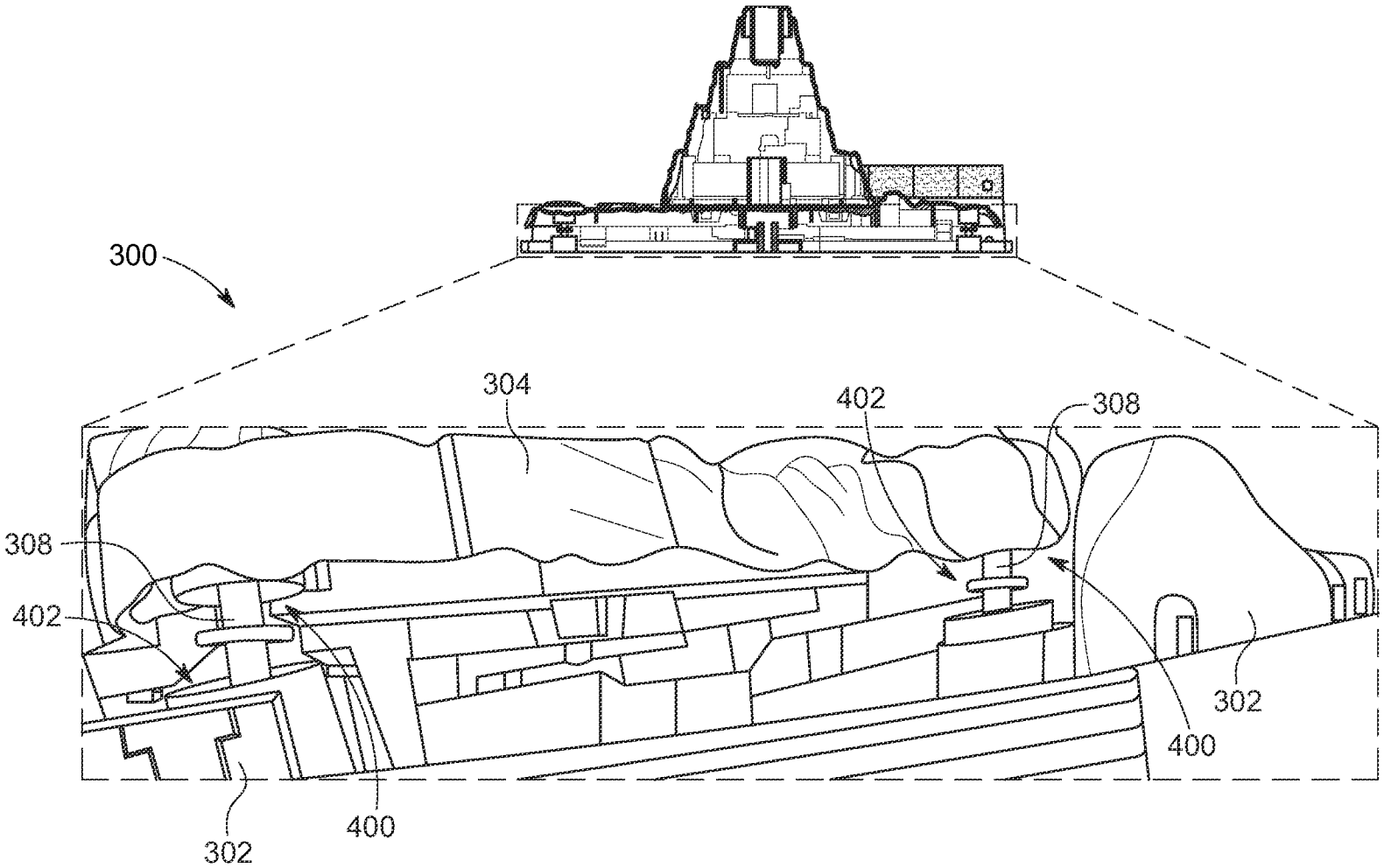
FIG. 8 illustrates a side perspective view of the toy playset of FIG. 6.

FIG. 8 illustrates a side view of the toy playset 300 providing further visualization of the supports 308. Each support 308 extends through a respective first aperture 400 of the track section 304 and through a respective second aperture 402 of the base section 302. The supports 308 are configured to move through the respective first apertures 400 to move relative to the track section 304. Additionally, the supports 308 are configured to move through the respective second apertures 402 to move relative to the base section 302. By way of example, a first portion of the base section 302 and a first portion of the track section 304 move relative to a first support 308 to move away from one another, whereas a second portion of the base section 302 and a second portion of the track section 304 move relative to a second support 308 to move toward one another. Such movement of the base section 302 and the track section 304 relative to one another may cause rotation of the base section 302 and the track section 304 relative to one another.

Figure 9:
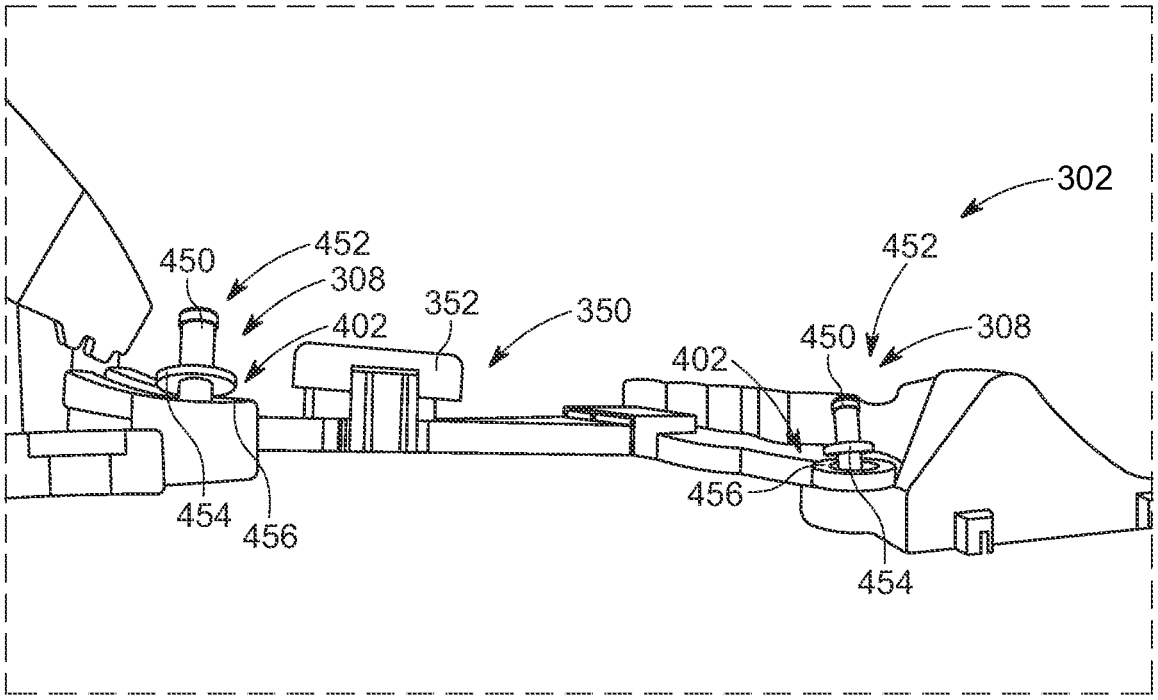
FIG. 9 illustrates a side perspective view of a base section of the toy playset of FIG. 6.

FIG. 9 illustrates a side view of the base section 302 of the toy playset 300. The track section 304 is not shown for visualization of the supports 308 attached to the base section 302. Each support 308 includes a first lip 450 at a first end 452. The first end 452 is configured to insert into the first aperture 400 of the track section 304, and the first lip 450 retains the support 308 within the first aperture 400. For example, the first lip 450 is configured to abut against the track section 304 to block movement of the support 308 out of the first aperture 400. Thus, the first lip 450 facilitates coupling of the support 308 to the track section 304.

Additionally, each support 308 includes a flange 454. The flange 454 may block certain movement of the support 308 relative to the base section 302. As discussed herein, the support 308 is configured to extend into the second aperture 402 of the base section 302. The flange 454 blocks extension of the support 308 into the second aperture 402 beyond a threshold distance. In particular, the flange 454 is configured to abut against a surface 456 of the base section 302 surrounding the second aperture 402 to block further movement of the support 308 into the second aperture 402. Blocking movement of the support 308 into the second aperture 402 may maintain a desirable positioning of the support 308 with respect to the base section 302 (e.g., to hold the support 308 against the base section 302) to facilitate coupling of the track section 304 to the support 308. This may also maintain a desirable orientation of the track section 304 coupled to the support 308 with respect to the base section 302, e.g., to retain the support 308 within the second aperture 402 and the like.

In the illustrated embodiment, the biasing joint 350 is coupled to the base section 302. Specifically, the base section 302 defines a receptacle, the biasing member of the biasing joint 350 extends into the receptacle, and the rod 354 of the biasing joint 350 extends into an aperture within the receptacle to secure the biasing joint 350 within the receptacle. The mount 352 of the biasing joint 350 is external to the receptacle and is configured to engage with the track section 304. The biasing member is configured to flex to enable movement of the mount 352 and of the track section 304 relative to the base section 302. However, in other embodiments, the biasing joint 350 may be arranged on the base section 302, the track section 304, or any combination thereof, and portions thereof may be arranged accordingly.

Figure 10:
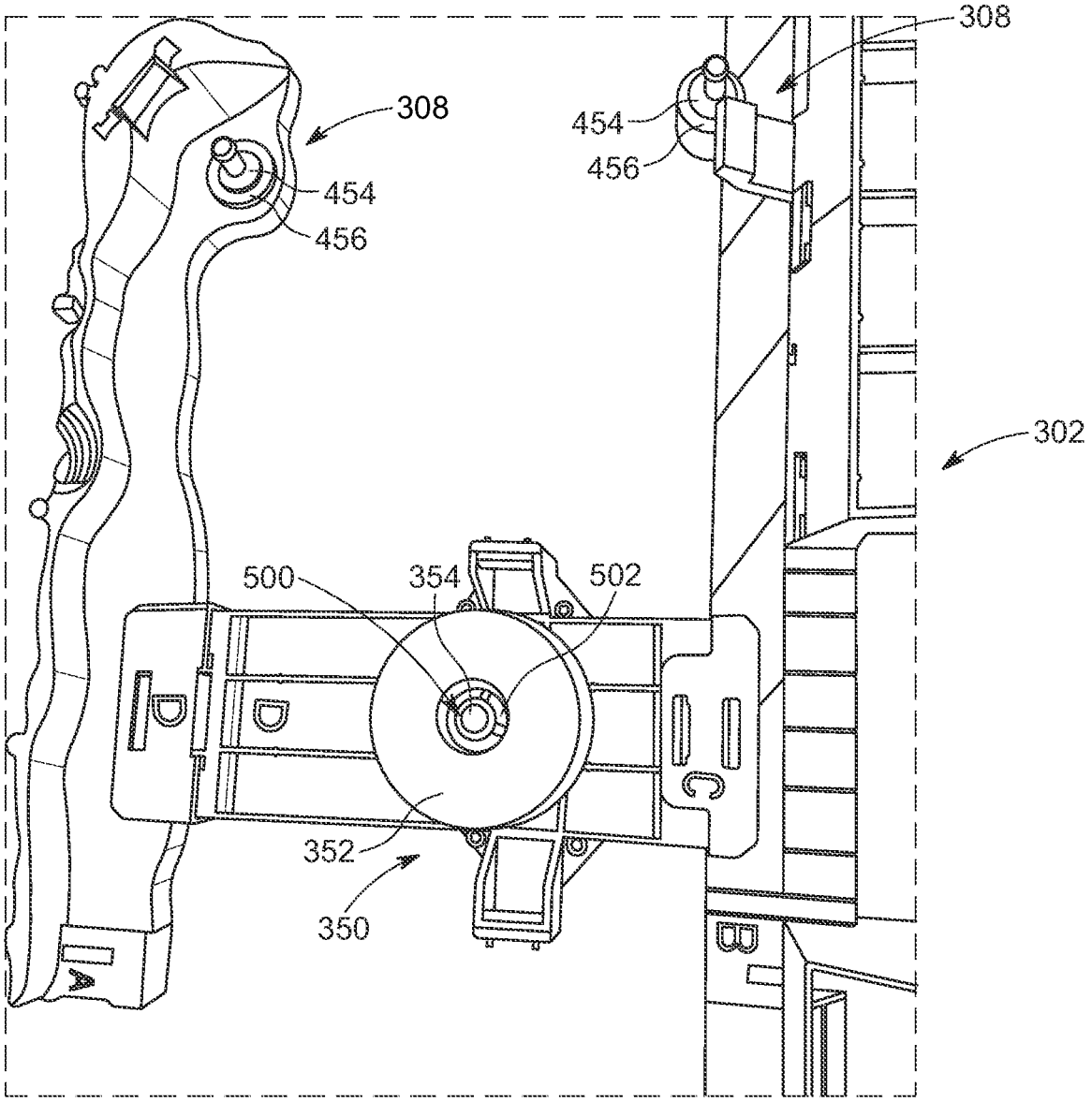
FIG. 10 illustrates a top perspective view of the base section of the toy playset of FIG. 6.

FIG. 10 illustrates a top view of the base section 302 of the toy playset 300. In the illustrated embodiment, the flanges 454 of the supports 308 are in abutment with the surface 456 of the base section 302. Additionally, the rod 354 of the biasing joint 350 is in abutment with the mount 352. For example, the rod 354 extends through an aperture 500 defined by the mount 352 and between projections 502 of the mount 352 extending into and around the aperture 500. The biasing member of the biasing joint 350 biases the mount 352 away from the base section 302 to cause the rod 354 (e.g., a lip of the rod 354) to abut against the mount 352. Such positioning of the support 308 against the base section 302 and the mount 352 against the rod 354 can facilitate coupling of the track section 304 to the base section 302.

Figure 11:
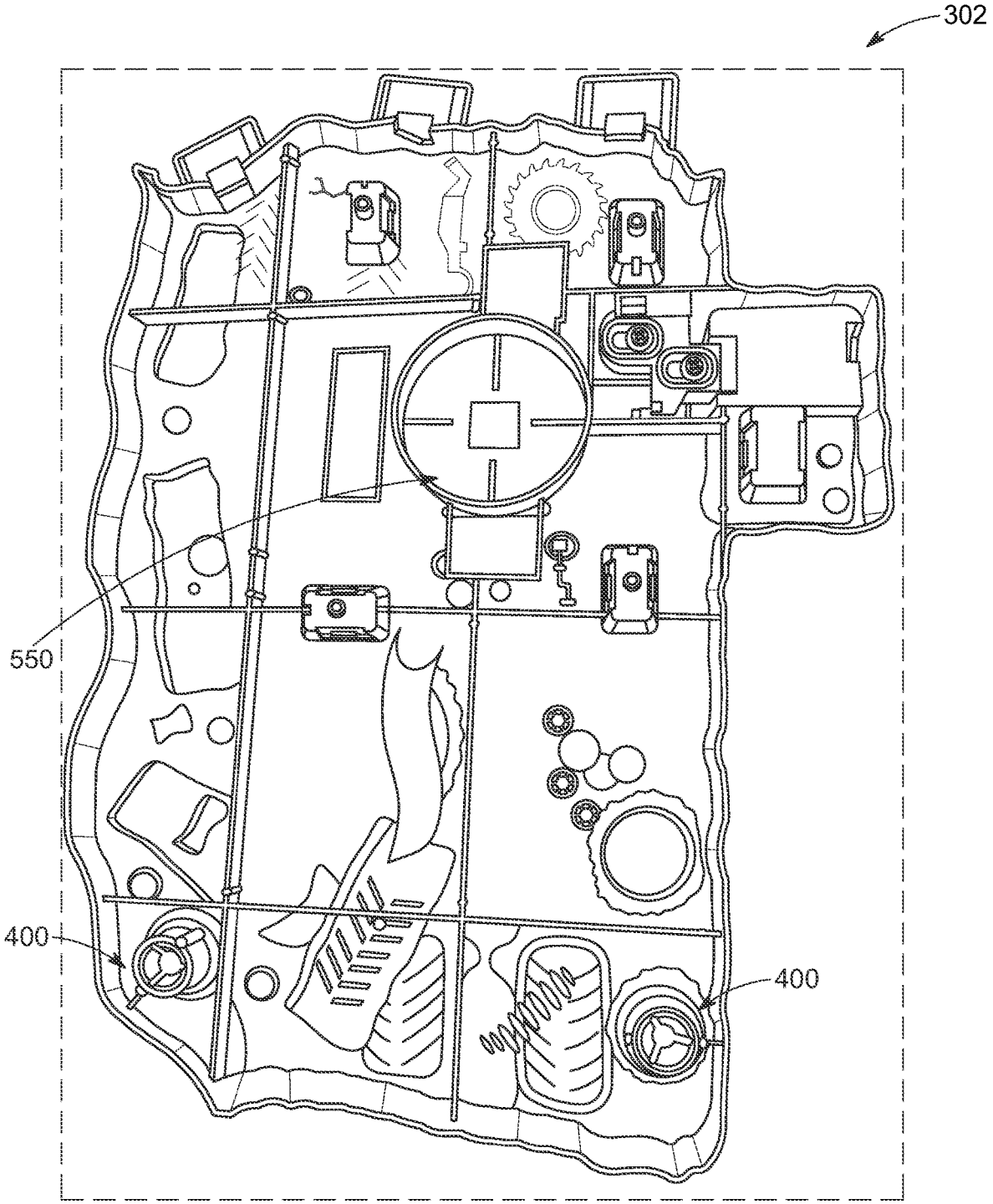
FIG. 11 illustrates a bottom view of a track section of the toy playset of FIG. 6.

FIG. 11 is a bottom view of the track section 304 of the toy playset 300. The track section 304 can be readily coupled to the base section 302, such as via a manually applied force. For example, the supports 308 coupled to the base section 302 can be inserted into the respective first apertures 400 of the track section 304 to couple the supports 308 to the track section 304. Thus, the supports 308 couple the base section 302 and the track section 304 to one another. Additionally, the track section 304 defines a receptacle 550, and the receptacle 550 is configured to receive the mount 352 of the biasing joint 350 coupled to the base section 302. Thus, in an assembled configuration of the toy playset 300, the supports 308 extend through the respective first apertures 400, and the mount 352 is positioned within the receptacle 550.

Figure 12:
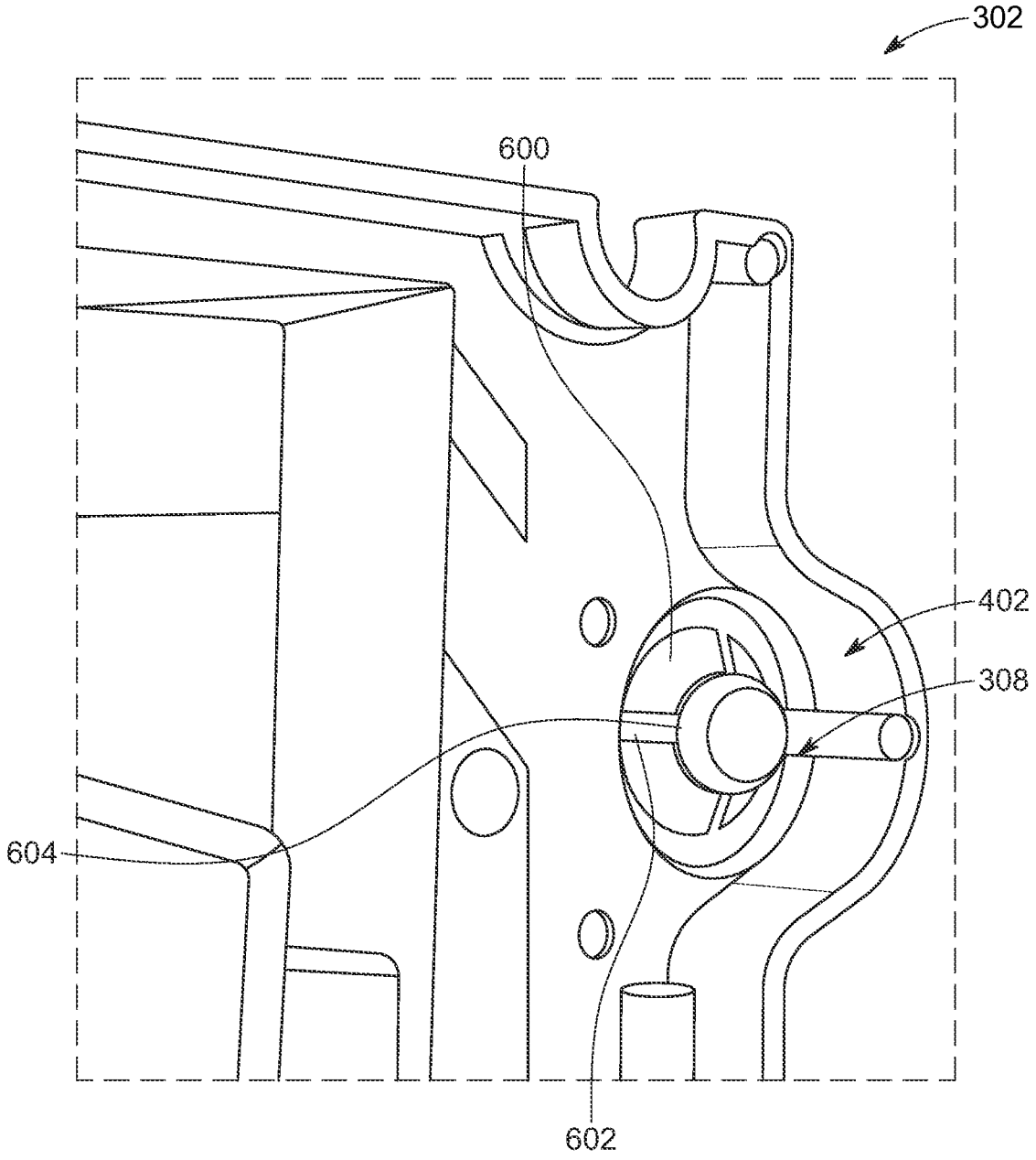
FIG. 12 illustrates a bottom perspective view of a portion of the base section and a support of the toy playset of FIG. 6.

FIG. 12 illustrates a bottom view of the base section 302 of the toy playset 300 with one of the supports 308 extending into the second aperture 402 of the base section 302. The base section 302 includes first projections 600 extending into and around the second aperture 402, and the support 308 includes a shaft 602 extending between the first projections 600 and into the second aperture 402. The support 308 also includes a first lip 604 that is in abutment against the first projections 600 in the illustrated embodiment. Abutment of the first lip 604 against the first projections 600 blocks movement of the support 308 out of the second aperture 402, thereby retaining the support 308 within the second aperture 402. A space formed between the first projections 600 is larger than the size of the shaft 602 to enable movement of the support 308 in the space between the first projections 600. For example, the shaft 602 may rotate and/or translate toward one of the first projections 600 and away from another one of the first projections 600 to enable corresponding movement of the base section 302 relative to the track section 304 coupled to the support 308.

Figure 13:
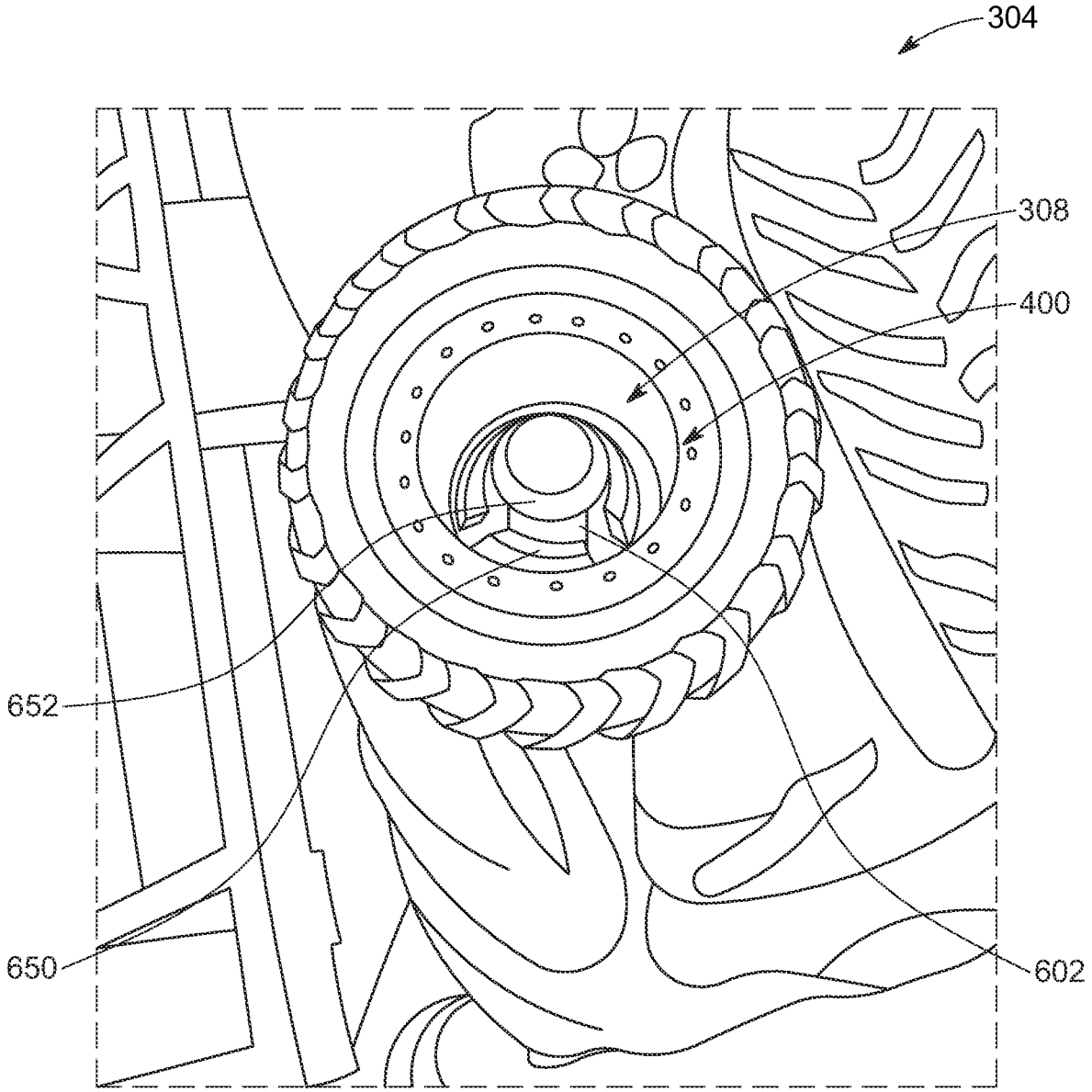
FIG. 13 illustrates a top perspective view of the track section and a support of the toy playset of FIG. 6.

FIG. 13 illustrates a top view of the track section 304 of the toy playset 300 with one of the supports 308 extending into the first aperture 400 of the track section 304. The track section 304 includes second projections 650 extending into and around the first aperture 400, and the shaft 602 extends between the second projections 650 and into the first aperture 400. The support 308 includes a second lip 652 configured to abut against the second projections 650 to block movement of the support 308 out of the first aperture 400, thereby retaining the support 308 within the first aperture 400. A space formed between the second projections 650 is larger than the size of the shaft 602 to enable movement of the support 308 in the space between the second projections 650, thereby enabling corresponding movement of the track section 304 relative to the base section 302 coupled to the support 308.

Figure 14:
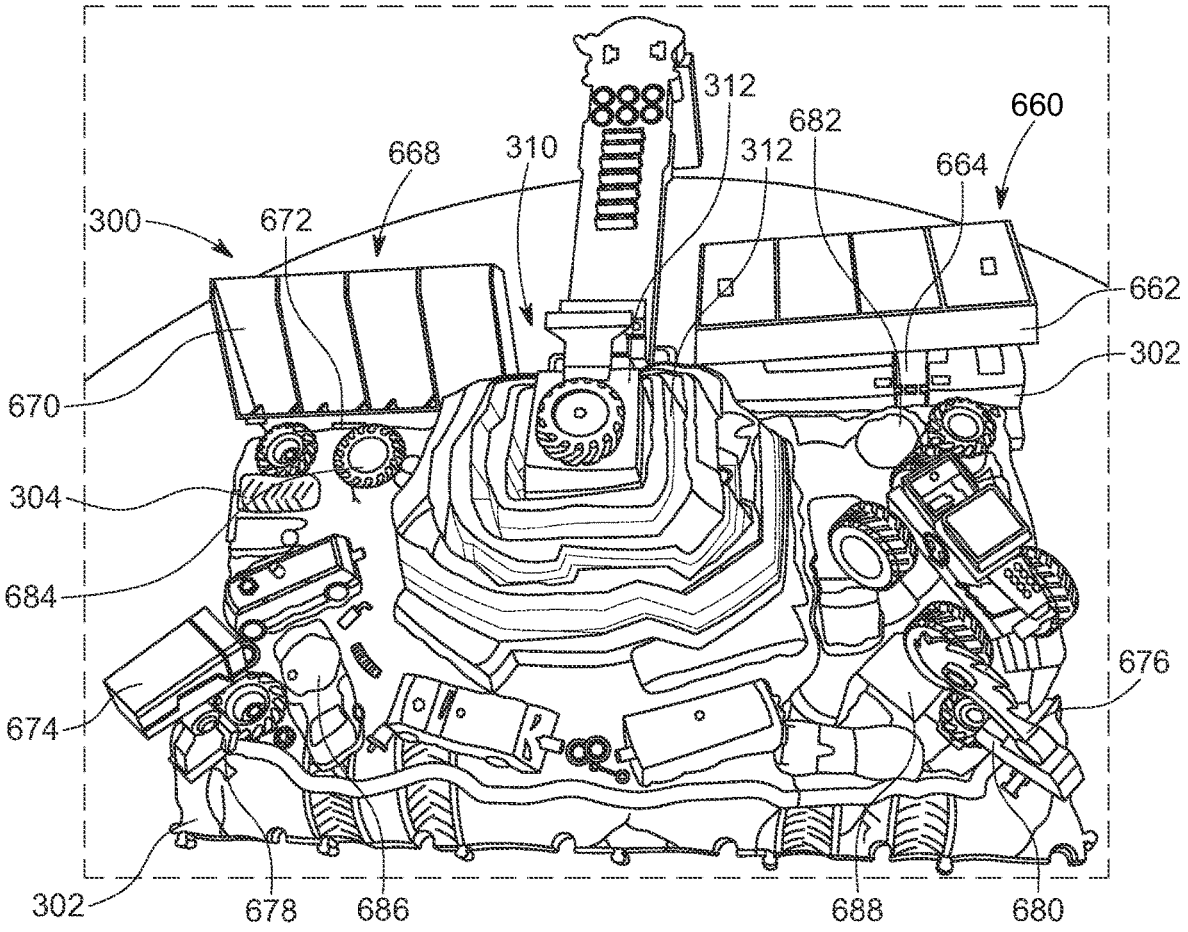
FIG. 14 illustrates a top perspective view of the toy playset of FIG. 6.

FIG. 14 illustrates a top perspective view of an embodiment of the toy playset 300. In the illustrated embodiment, the tower portions 312 of the tower 310 are pressed into one another (e.g., via a telescoping mechanism). Pressing of the tower portions 312 into one another may cause compression of the biasing member of the toy playset 300. For example, pressing of the tower portions 312 toward the track section 304 may cause one of the tower portions 312 to extend through the track section 304 and engage with the mount 352 to drive the mount 352 toward the base section 302, thereby compressing the biasing member that extends between the mount 352 and the base section 302. As a result of the movement of the mount 352 toward the base section 302, the track section 304 in engagement with the mount 352 may also move toward the base section 302. Additionally, a compressed configuration of the biasing member may limit movement of the mount 352 relative to the base section 302, thereby limiting relative movement between the base section 302 and the track section 304 via the biasing joint 350. That is, while the tower portions 312 are pressed, the position of the track section 304 relative to the base section 302 may be substantially maintained.

As discussed herein, movement of the track section 304 relative to the base section 302 may actuate various components of the toy playset 300. As an example, a first component 660 (e.g., a first lever-actuated component) includes a first actuatable plate 662 coupled to and configured to move relative to the base section 302. For instance, the first actuatable plate 662 is configured to rotate relative to the base section 302. A lever 664 of the first component 660 is rotatably coupled to the base section 302, and a first end of the lever 664 extends between the base section 302 and the track section 304 while a second end of the lever 664 extends between the base section 302 and the first actuatable plate 662. Thus, movement of the track section 304 toward the base section 302 can cause the track section 304 to engage the first end of the lever 664 and cause the first end of the lever 664 to move toward the base section 302. Movement of the first end of the lever 664 toward the base section 302 causes the lever 664 to rotate relative to the base section 302 and moves the second end of the lever 664 in engagement with the first actuatable plate 662. The second end of the lever 664 may then drive movement of the first actuatable plate 662 relative to the base section 302 (e.g., to raise a portion of the first actuatable plate 662), thereby actuating the first component 660. For example, the component 660 may resemble stands and be able to hold toy vehicles. Then, actuation of lever 664 may cause the stands to dump or drop the toy vehicles.

Additionally, a second component 668 (e.g., a second lever-actuated component) includes a second actuatable plate 670 coupled to and configured to rotate relative to the base section 302. The second actuatable plate 670 includes a lever portion 672 configured to extend between the base section 302 and the track section 304. Movement of the track section 304 toward the base section 302 causes the track section 304 to engage the lever portion 672, thereby causing the lever portion 672 to move toward the base section 302. Movement of the lever portion 672 toward the base section 302 causes the second actuatable plate 670 to rotate relative to the base section 302, such as to lower a portion of the second actuatable plate 670.

The toy playset 300 further includes a third component 674 (e.g., a first post) coupled to and configured to rotate relative to the base section 302, as well as a fourth component 676 (e.g., a second post) coupled to and configured to rotate relative to the base section 302. The third component 674 includes a first surface 678 configured to engage the track section 304. For instance, a gravitational force urges rotation of the third component 674 with respect to the base section 302 to move the first surface 678 in abutment with the track section 304. Thus, movement of the track section 304 relative to the base section 302 may cause the third component 674 to move relative to the base section 302 to actuate the third component 674. For example, movement of the track section 304 toward the base section 302 may cause the third component 674 to rotate relative to the base section 302 and toward the track section 304 to enable the first surface 678 to remain in engagement with the track section 304. The fourth component 676 may similarly include a second surface 680 configured to remain in engagement with the track section 304 (e.g., via a gravitational force). Thus, movement of the track section 304 relative to the base section 302 may move the fourth component 676 relative to the base section 302 to actuate the fourth component 676.

In certain embodiments, the components 660, 668, 674, 676 may be independently actuatable. In other words, the track section 304 may be moved relative to the base section 302 to move a subset of the components 660, 668, 674, 676 and not a remainder of the components 660, 668, 674, 676. By way of example, the track section 304 includes a plurality of actuatable points. Moving the track section 304 at one of the actuatable point may cause an adjacent component, but not other components located away from the actuatable point, to actuate. For instance, movement of the track section 304 at a first actuatable point 682 toward the base section 302 may cause actuation of the first component 660, movement of the track section 304 at a second actuatable point 684 toward the base section 302 may cause actuation of the second component 668, movement of the track section 304 at a third actuatable point 686 toward the base section 302 may cause actuation of the third component 674, and movement of the track section 304 at a fourth actuatable point 688 toward the base section 302 may cause actuation of the fourth component 676. Thus, each of the components 660, 668, 674, 676 may be selectively actuated to entertain a user.

Figure 15:
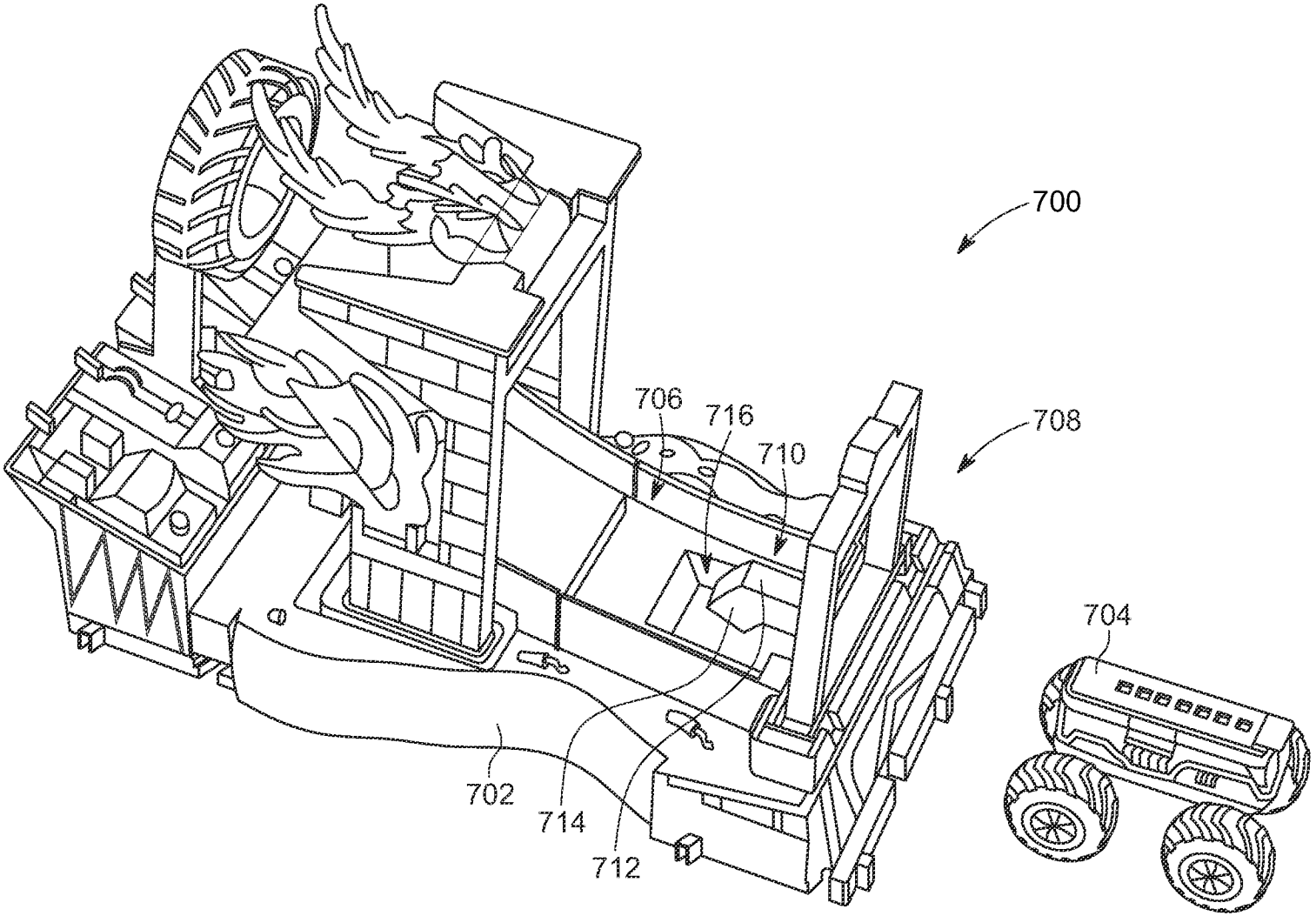
FIG. 15 illustrates a perspective view of a toy playset having an arm and a toy vehicle in accordance with yet another example embodiment of the present application.

FIG. 15 illustrates a perspective view of an embodiment of a toy playset 700, which may have any of the features discussed herein with respect to sections that are movable relative to one another via a biasing joint. Additionally or alternatively, the toy playset 700 includes a track section 702 configured to receive a toy vehicle 704. For instance, the track section 702 defines a channel 706 configured to receive the toy vehicle 704. The toy playset 700 further includes a launcher arm 708, which may be used to drive movement of the toy vehicle 704 along the track section 702 (i.e., to impart an acceleration/propulsion force to the toy vehicle 704). In the depicted embodiment, the launcher arm 708 is coupled to the track section 702 and is movable relative to the track section 702 so that the launcher arm 708 can transition between a loaded configuration and a rest configuration. The launcher arm 708 is configured to contact the toy vehicle 704 during movement relative to the track section 702 to cause the toy vehicle 704 to move along the track section 702.

The launcher arm 708 includes an extension 710 configured to contact the toy vehicle 704 to move the toy vehicle 704. The extension 710 includes a first segment 712 and a second segment 714 extending relatively crosswise from the first segment 712. Additionally, the track section 702 includes a recess 716 formed within channel 706. The recess 716 accommodates the profile of the extension 710 in the rest configuration of the launcher arm 708. For example, the first segment 712 may extend generally along the track section 702 (e.g., along the channel 706) in the rest configuration of the launcher arm 708, and the second segment 714 may extend toward the track section 702 (e.g., through the channel 706) and into the recess 716 in the rest configuration of the launcher arm 708. As discussed herein, the orientation of the first segment 712 and the second segment 714 relative to one another may facilitate providing a sufficient acceleration/propulsion force via the extension 710 to propel the toy vehicle 704 along the track section 702.

Figure 16:
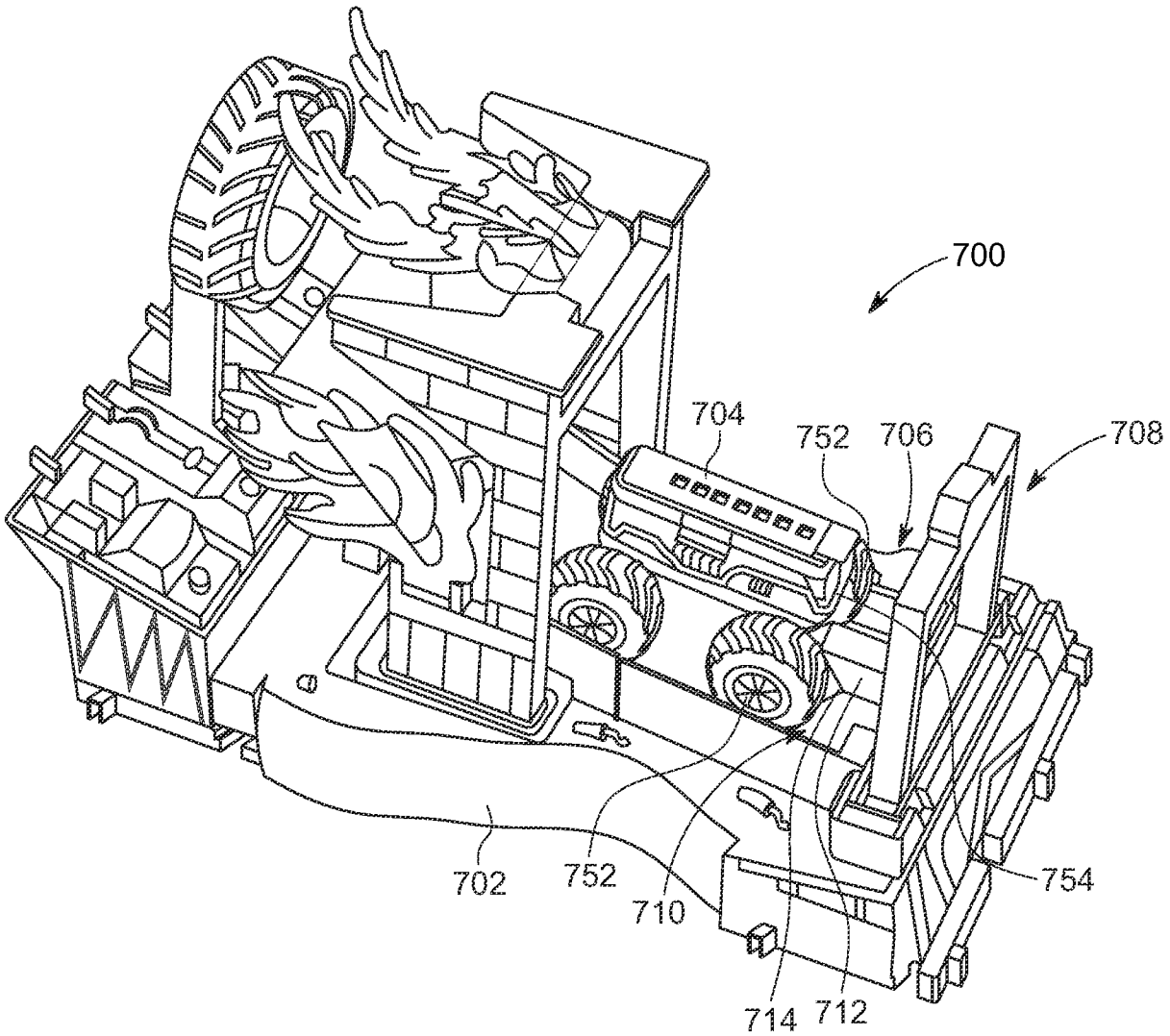
FIG. 16 illustrates a perspective view of the toy playset of FIG. 15 in which the arm is in a rest configuration and in engagement with the toy vehicle.

FIG. 16 illustrates a perspective view of the toy playset 700 in which the toy vehicle 704 is positioned within the channel 706. In the illustrated embodiment, the launcher arm 708 is in the rest configuration (e.g., a fully resting configuration). In the rest configuration, the second segment 714 of the extension 710 extends into the channel 706, and the first segment 712 of the extension 710 extends along the channel 706. Positioning of the toy vehicle 704 within the channel 706 may cause the toy vehicle 704 to be placed in engagement with the first segment 712 of the extension 710 while the launcher arm 708 is in the rest configuration. For example, wheels 752 of the toy vehicle 704 straddle the extension 710, and a chassis 754 rests against the first segment 712 of the extension 710. The positioning of the second segment 714 within the recess 716 of the track section 702 enables the extension 710 to be positioned within the channel 706 in a manner that accommodates placement of the toy vehicle 704 within the channel 706 and against the first segment 712 of the extension 710.

Figure 17:
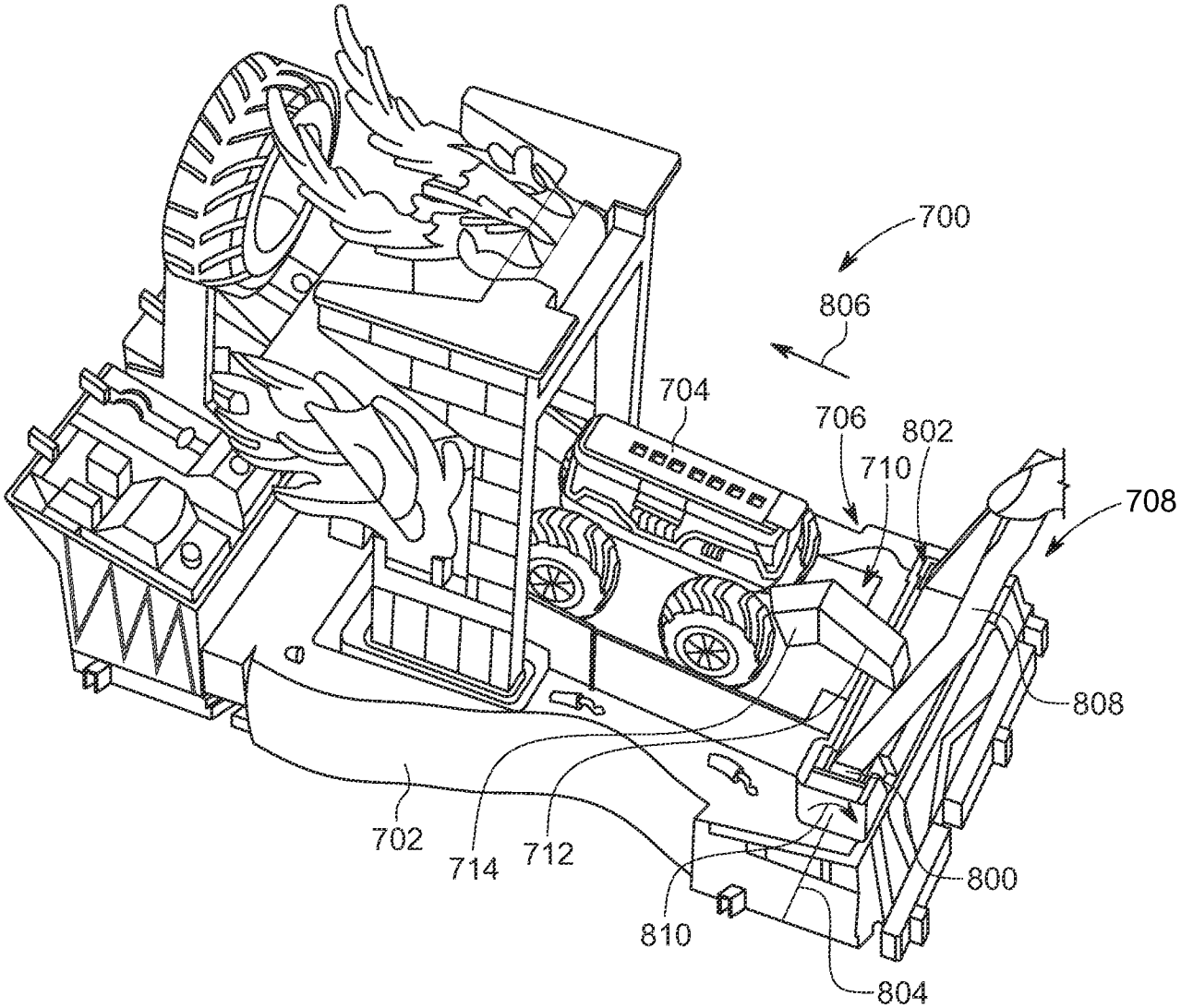
FIG. 17 illustrates a perspective view of the toy playset of FIG. 15 in which the arm is transitioning between the rest configuration and a loaded configuration.

FIG. 17 illustrates a perspective view of the toy playset 700 in which the launcher arm 708 is in transition from the rest configuration to the loaded configuration (e.g., the launcher arm 708 is in a partially resting configuration or a partially loaded configuration). For instance, the launcher arm 708 includes a shaft 800 coupled to the track section 702. By way of example, the shaft 800 may be positioned within a recess 802 defined by the track section 702 and is configured to rotate about an axis 804 to transition the launcher arm 708 from the rest configuration to the loaded configuration. The first segment 712 of the extension 710 extends from the shaft 800. Therefore, rotation of the shaft 800 relative to the track section 702 drives rotation of the extension 710 relative to the track section 702.

Moreover, because the extension 710 is in contact with the toy vehicle 704 in the rest configuration of the launcher arm 708, rotation of the extension 710 relative to the track section 702 may impart some force onto the toy vehicle 704, such as in a first direction 806 (e.g., a forward direction) along the channel 706 and away from the launcher arm 708. Movement of the toy vehicle 704 along the channel 706 in the first direction 806 may provide sufficient clearance to enable movement of the extension 710 out of the channel 706 to enable transition of the launcher arm 708 to the loaded configuration. Additionally, the crosswise orientation between the first segment 712 and the second segment 714 of the extension 710 may facilitate movement of the launcher arm 708 to the loaded configuration. For example, the crosswise orientation between the first segment 712 and the second segment 714 of the extension 710 may enable the first segment 712 and the second segment 714 to slide along the toy vehicle 704 to move the toy vehicle 704 in the first direction 806 during movement of the extension 710 out of the channel 706. In other words, the orientation between the first segment 712 and the second segment 714 facilitate movement of the extension 710 relative to the toy vehicle 704 while the toy vehicle 704 is in contact with the extension 710.

In some embodiments, the launcher arm 708 may be transitioned to the loaded configuration via a manually applied force. As an example, the launcher arm 708 includes a handle 808 extending from the shaft 800. A user may utilize (e.g., grip) the handle 808 to drive rotation of the shaft 800 and of the extension 710 relative to the track section 702. For instance, the user may rotate the handle 808 about the axis 804 in a first rotational direction 810 toward the track section 702 to transition the launcher arm 708 to the loaded configuration. Generally, the first rotational direction 810 may be considered rearward and downward. Accordingly, downward movement of the handle 808 moves the extension 710 away from the toy vehicle 704 positioned in the channel 706. Thus, after rotation to the loaded configuration, biasing of the launcher arm 708 may rotate the launcher arm 708 in forward and upward directions toward the toy vehicle 704 positioned in the channel 706, as is detailed below.

Figure 18:
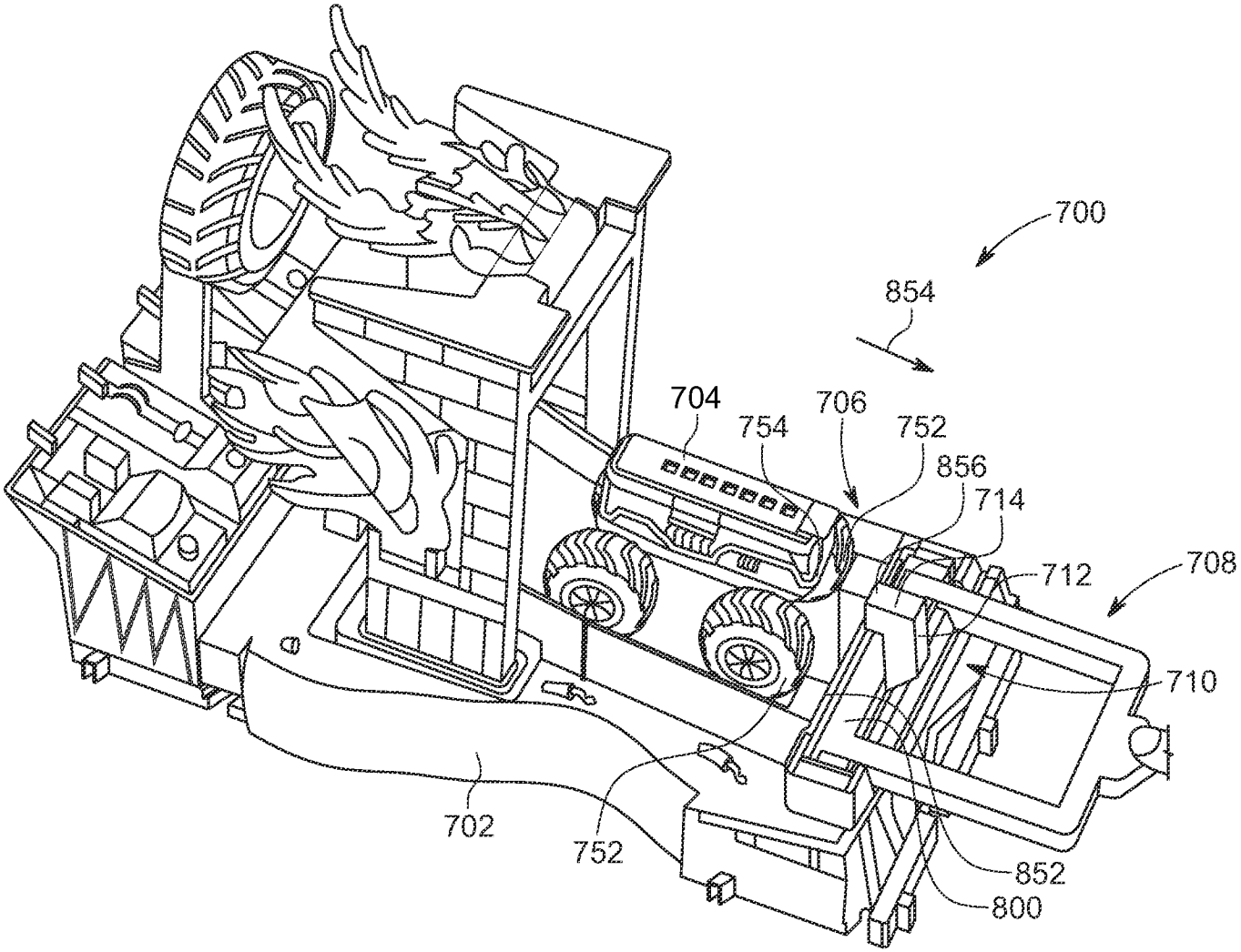
FIG. 18 illustrates a perspective view of the toy playset of FIG. 15 in which the arm is in a loaded configuration.

FIG. 18 illustrates a perspective view of the toy playset 700 in which the launcher arm 708 is in the loaded configuration (e.g., a fully loaded configuration). In the loaded configuration, the extension 710 is external to the channel 706 and is offset (e.g., disengaged) from the toy vehicle 704. As a result, the toy vehicle 704 (e.g., the wheels 752) may abut against a wall 850 (e.g., a back wall) of the track section 702 extending adjacent to the channel 706. For example, a gravitational force may urge the toy vehicle 704 to move in a second direction 854 (e.g., a backward direction), opposite the first direction 806, toward the launcher arm 708. However, the wall 850 blocks contact between the toy vehicle 704 and the extension 710. In the loaded configuration of the launcher arm 708, the second segment 714 of the extension 710 extends toward the toy vehicle 704 that is in abutment with the wall 852. For example, the first segment 712 of the extension 710 extends from the shaft 800 in a generally vertical direction (e.g., along the chassis 754 of the toy vehicle 704) in the loaded configuration, and the second segment 714 of the extension 710 curves from the first segment 712 toward the toy vehicle 704 in the loaded configuration. As a result, a surface 856 of the second segment 714 of the extension 710 faces the toy vehicle 704 that is in abutment with the wall 852.

Figure 19:
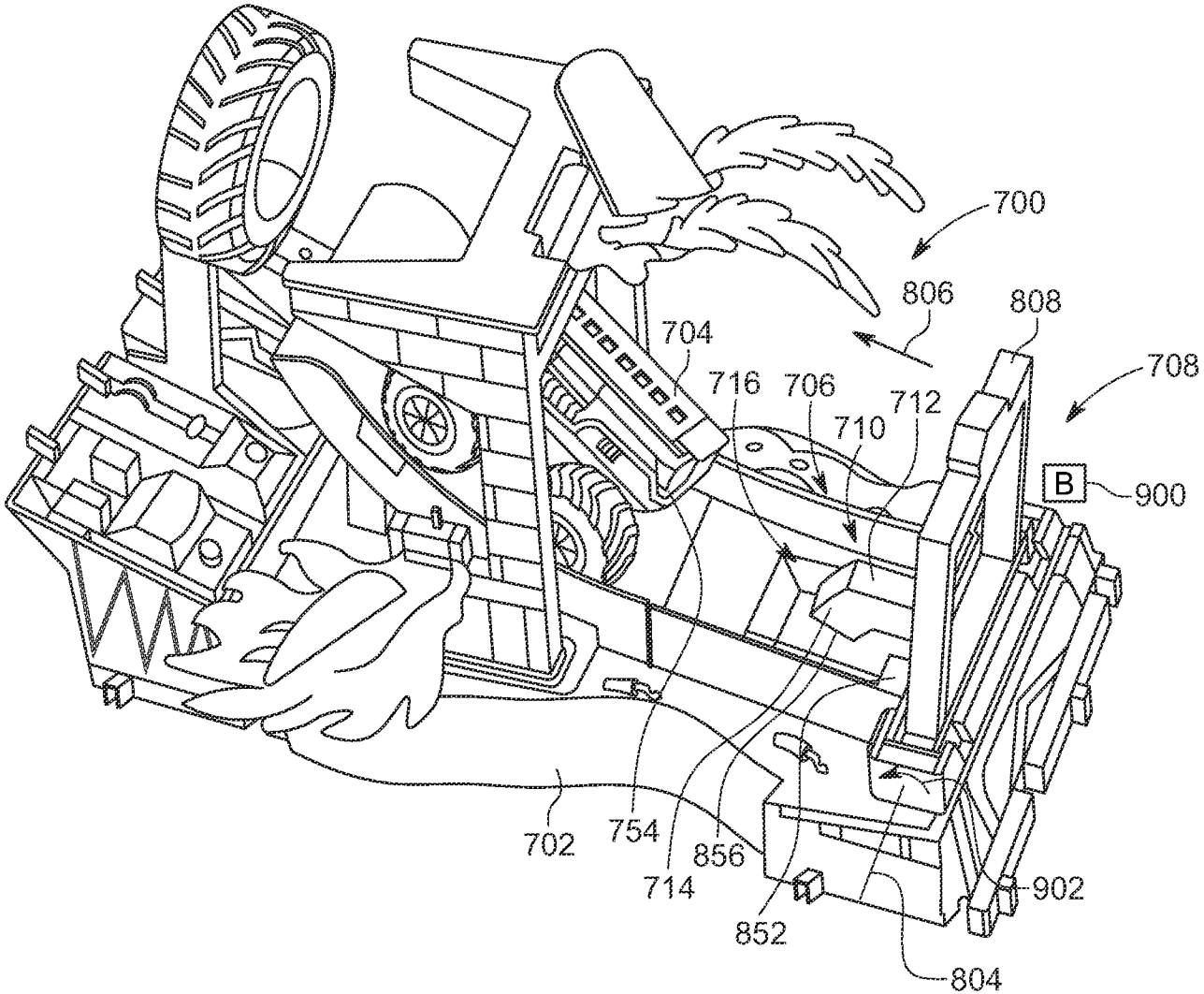
FIG. 19 illustrates a perspective view of the toy playset of FIG. 15 in which the toy vehicle moves along a track section as a result of engagement with the arm.

FIG. 19 illustrates a perspective view of the toy playset 700 in which the launcher arm 708 is in the rest configuration. By way of example, the toy playset 700 includes an arm biasing member 900 (e.g., a spring) configured to urge movement of the launcher arm 708 in a second rotational direction 902, which may include upward and forward directions that are opposite the first rotational direction 810, toward the rest configuration. Thus, absent a force (e.g., a manually applied force) imparted onto the launcher arm 708 to maintain the launcher arm 708 in the loaded configuration, the arm biasing member 900 causes movement of the launcher arm 708 in the second rotational direction 902. Rotation of the launcher arm 708 in the second rotational direction 902 causes movement of the handle 808 away from the track section 702 and movement of the extension 710 toward the toy vehicle 704 positioned within the channel 706 and in abutment with the wall 852. That is, upward movement of the handle 808 causes movement of the extension 710 toward the toy vehicle 704.

The extension 710 may contact the toy vehicle 704 positioned within the channel 706 and in abutment with the wall 852 during transition of the launcher arm 708 toward the rest configuration. For example, the first segment 712 of the extension 710 moves toward the channel 706 during transition of the launcher arm 708 toward the rest configuration, and the surface 856 may abut against the toy vehicle 704 positioned within the channel 706 as a result. Abutment of the extension 710 against the toy vehicle 704 imparts an acceleration/propulsion force that drives movement of the toy vehicle 704 in the first direction 806 along the channel 706 and away from the launcher arm 708. The orientation of the first segment 712 and the second segment 714 relative to one another may enable the surface 856 to contact the toy vehicle 704 in a desirable manner to propel the toy vehicle 704 along the channel 706 (e.g., at a sufficient speed for discharge from the channel 706). For instance, the surface 856 may be substantially flush with the chassis 754 of the toy vehicle 704 and/or substantially perpendicular to the first direction 806 during contact with the toy vehicle 704 as a result of the crosswise orientation between the first segment 712 and the second segment 714. Such orientation of the surface 856 relative to the chassis 754 (e.g., as opposed to the surface 856 being oriented at an angle relative to the chassis 754) may impart an acceleration/propulsion force onto the toy vehicle 704 in the first direction 806 instead of in a crosswise direction (e.g., an upward direction, a downward direction, a lateral direction) relative to the first direction 806. Thus, contact between the surface 856 and the toy vehicle 704 may drive movement of the toy vehicle 704 in the first direction 806 and along the track section 702 instead of, for example, lifting the toy vehicle 704 away from the track section 702 and/or driving the toy vehicle 704 further against the track section 702. The second segment 714 of the extension 710 may then extend into the recess 716 of the track section 702 formed within the channel 706 to enable the toy vehicle 704 or another toy vehicle 704 to be positioned within the channel 706 and against the first segment 712 of the extension 710.

While the toy playset presented herein has been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy playset described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Moreover, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". For example, the term "approximately" can denote a tolerance of plus or minus 0.002 inches, 0.001 inches, or up to 0.005 inches. The same applies to the terms "about" and "around" and "substantially." Moreover, for the purposes of the present disclosure, the phrase "A and/or B" means (A), (B), or (A and B), and the phrase "A, B, and/or C" means (A), (B), (C), (A and B), (A and C), (B and C), or (A, B and C).

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A toy playset, comprising:

a base section;

a track section configured to receive a toy vehicle;

a biasing member coupled to the base section and to the track section, wherein the biasing member is configured to bias the base section and the track section away from one another, and the biasing member is configured to flex to enable the base section and the track section to move relative to one another;

a rod configured to extend through the biasing member, wherein the rod is configured to couple the base section and the track section to one another, and the rod comprises a first lip and a second lip; and a mount coupled to the rod and to the biasing member, wherein the track section is in engagement with the mount, and the biasing member is configured to bias the mount and the base section away from one another to bias the base section and the track section away from one another, wherein the mount defines a first aperture and comprises first projections that extend into and around the first aperture, the base section defines a second aperture and comprises second projections that extend into and around the second aperture, the rod is configured to extend into the first aperture and the second aperture, the mount is configured to move relative to the rod via the first aperture, the base section is configured to move relative to the rod via the second aperture, and the biasing member is configured to bias the mount and the base section away from one another to abut the first lip of the rod with the first projections of the mount and to abut the second lip of the rod with the second projections of the base section.

2. The toy playset of claim 1, wherein the biasing member comprises a coil spring that surrounds the first aperture and the second aperture such that the rod extends through the coil spring.

3. The toy playset of claim 1, wherein the track section comprises a channel configured to receive the toy vehicle.

4. The toy playset of claim 3, comprising a launcher arm configured to move between a loaded configuration and a rest configuration, and the launcher arm comprises an extension configured to extend into the channel and engage the toy vehicle positioned in the channel in the rest configuration of the launcher arm, the extension having a segment that curves towards the toy vehicle in the loaded configuration of the launcher arm.

5. The toy playset of claim 4, wherein the extension is positioned external to the channel in the loaded configuration of the launcher arm.

6. The toy playset of claim 4, wherein the launcher arm comprises a shaft configured to rotate relative to the track section to transition the launcher arm between the loaded configuration and the rest configuration, and the extension extends from the shaft such that rotation of the shaft relative to the track section drives rotation of the extension relative to the track section.

7. The toy playset of claim 6, wherein the launcher arm comprises a handle extending from the shaft, the handle is configured to rotate toward the track section to transition the launcher arm toward the loaded configuration, and the handle is configured to rotate away from the track section to transition the launcher arm toward the rest configuration.

8. The toy playset of claim 4, wherein the extension is offset from the toy vehicle in the loaded configuration, and the toy playset comprises an arm biasing member configured to urge the launcher arm toward the rest configuration and to urge the extension toward the toy vehicle positioned in the channel.

9. A toy playset, comprising:

a base section defining a first aperture and comprising first projections that extend into and around the first aperture;

a track section; and a biasing joint comprising:

a mount defining a second aperture and comprising second projections that extend into and around the second aperture, wherein the track section is in engagement with the mount;

a biasing member coupled to the base section and to the track section, wherein the biasing member is configured to bias the mount and the base section away from one another to bias the base section and the track section away from one another, and the biasing member is configured to flex to enable the base section and the track section to move relative to one another; and a rod extending through the biasing member, into the first aperture of the base section, and into the second aperture of the mount, wherein the rod is configured to couple the base section and the track section to one another, the mount is coupled to the rod and to the biasing member, the base section is configured to move relative to the rod via the first aperture, the mount is configured to move relative to the rod via the second aperture, the rod comprises a first lip and a second lip, and the biasing member is configured to bias the mount and the base section away from one another to abut the first lip of the rod with the first projections of the base section and to abut the second lip of the rod with the second projections of the mount.

10. The toy playset of claim 9, comprising an additional rod external to the biasing member, wherein the additional rod is configured to extend through a third aperture of the track section, and the track section is configured to move along the additional rod via the third aperture of the track section to move relative to the base section.

11. The toy playset of claim 10, wherein the additional rod comprises a lip configured to abut the track section to block movement of the additional rod out of the third aperture of the track section.

12. The toy playset of claim 9, comprising an additional component coupled to the track section, wherein the additional component is movable relative to the track section, and movement of the track section relative to the base section causes the track section to engage the additional component and move the additional component relative to the track section.

13. The toy playset of claim 9, wherein the base section defines a receptacle that includes the first aperture, and the biasing member extends into the receptacle.

14. A toy playset, comprising:

a first section defining a first aperture and comprising first projections that extend into and around the first aperture;

a second section; and a biasing joint comprising:

a mount in engagement with the second section, wherein the mount defines a second aperture and comprises second projections that extend into and around the second aperture;

a biasing member coupled to the second section via the mount and coupled to the first section, wherein the biasing member is configured to bias the first section and the mount away from one another to bias the first section and the second section away from one another, and the biasing member is configured to flex to enable the first section and the second section to move relative to one another; and a rod coupled to the first section and to the mount to couple the first section and the second section to one another, wherein the rod extends through the biasing member and into the first aperture and the second aperture, and the rod comprises a first lip and a second lip, wherein the first section is configured to move relative to the rod via the first aperture, the mount is configured to move relative to the rod via the second aperture, and the biasing member is configured to bias the first section and the mount away from one another to abut the first lip of the rod with the first projections of the first section and to abut the second lip of the rod with the second projections of the mount.

15. The toy playset of claim 14, wherein the second section comprises a third aperture, and the rod is configured to extend through the third aperture.

16. The toy playset of claim 14, wherein the second section defines a receptacle configured to receive the mount to engage the second section with the mount.

* * * * *